US009709933B2

(12) United States Patent
Hayashi et al.

(10) Patent No.: US 9,709,933 B2
(45) Date of Patent: Jul. 18, 2017

(54) HEATING DEVICE AND IMAGE FORMING APPARATUS

(71) Applicants: Takashi Hayashi, Osaka (JP); Akira Yashiro, Osaka (JP); Kenji Sueyoshi, Osaka (JP); Hiroki Okada, Osaka (JP)

(72) Inventors: Takashi Hayashi, Osaka (JP); Akira Yashiro, Osaka (JP); Kenji Sueyoshi, Osaka (JP); Hiroki Okada, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/059,893

(22) Filed: Mar. 3, 2016

(65) Prior Publication Data

US 2016/0266526 A1 Sep. 15, 2016

(30) Foreign Application Priority Data

Mar. 11, 2015 (JP) ..... 2015-048196
Feb. 18, 2016 (JP) ..... 2016-028927

(51) Int. Cl.
*G03G 15/20* (2006.01)
*G03G 15/00* (2006.01)

(52) U.S. Cl.
CPC ..... *G03G 15/2039* (2013.01); *G03G 15/5004* (2013.01); *G03G 15/80* (2013.01)

(58) Field of Classification Search
None
See application file for complete search history.

(56) References Cited

U.S. PATENT DOCUMENTS

2005/0201767 A1* 9/2005 Peng ..... G03G 15/205 399/69
2010/0045728 A1* 2/2010 Suzuki ..... B41J 2/04528 347/17
2010/0239301 A1* 9/2010 Nemoto ..... G03G 15/2039 399/69

FOREIGN PATENT DOCUMENTS

JP 11-095606 4/1999
JP 2003217793 A * 7/2003
JP 2008-287143 11/2008
JP 2010-244036 10/2010
JP 2011112911 A * 6/2011

OTHER PUBLICATIONS

JP_2003217793_A_T Machine Translation, Japan, Hosoi, Jul. 2003.*
JP_2011112911_A_T Machine Translation, Japan, Asano, 2011.*

* cited by examiner

*Primary Examiner* — Clayton E LaBalle
*Assistant Examiner* — Victor Verbitsky
(74) *Attorney, Agent, or Firm* — Oblon, McClelland, Maier & Neustadt, L.L.P.

(57) ABSTRACT

A heating device includes: a heater; and a power distribution controller. The heater heats a predetermined heating target. The power distribution controller controls supply of AC power to the heater. The power distribution controller performs power distribution to the heater in units of AC half wave, and controls the power supply to the heater in accordance with power distribution control patterns respectively corresponding to a first time period as a power distribution start period, a third time period as a power distribution stop period, and a second time period between the first time period and the third time period.

20 Claims, 22 Drawing Sheets

FIG. 2A
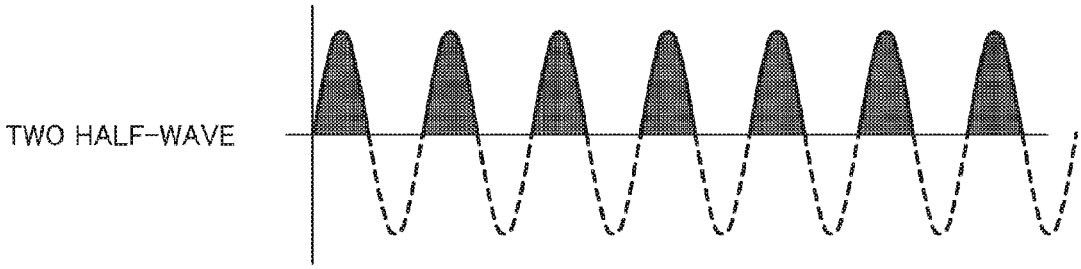
FIG. 2B
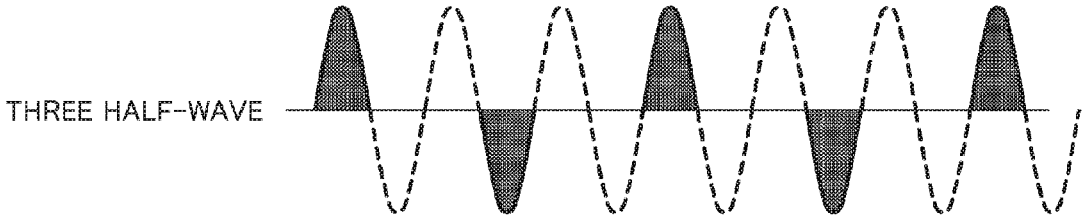
FIG. 2C
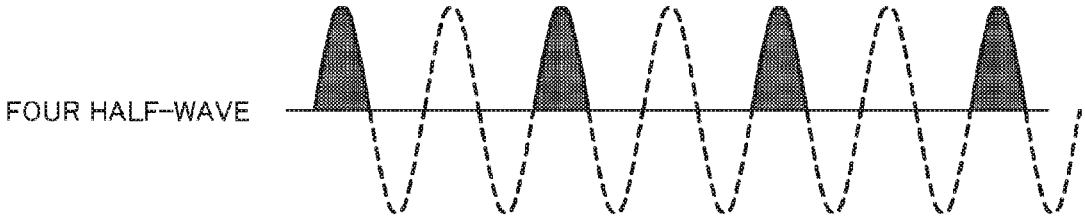
FIG. 3A
$$F(s)=\frac{k\omega_1 s}{s^2+2\lambda s+\omega_1^2}\times\frac{1+\frac{s}{\omega_2}}{\left(1+\frac{s}{\omega_3}\right)\left(1+\frac{s}{\omega_4}\right)}$$
$k=1.74802$ $\lambda=2\pi 4.05981$
$\omega_1=2\pi 9.15494$ $\omega_2=2\pi 2.27979$
$\omega_3=2\pi 1.22535$ $\omega_4=2\pi 21.9$

| n | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | ··120 |
|---|---|---|---|---|---|---|---|---|---|---|---|---|---|---|---|---|---|---|---|---|---|---|---|---|---|---|---|---|---|
| FIRST HEATER | 1 | 0 | 0 | 0 | 0 | 0 | 0 | 1 | 0 | 0 | 0 | 0 | 1 | 0 | 0 | 0 | 1 | 0 | 0 | 0 | 1 | 0 | 0 | 0 | 1 | 0 | 0 | 0 | ··· |
| SECOND HEATER | 0 | 0 | 0 | 0 | 1 | 0 | 0 | 0 | 0 | 0 | 1 | 0 | 0 | 0 | 1 | 0 | 0 | 0 | 1 | 0 | 0 | 0 | 1 | 0 | 0 | 0 | 1 | 0 | ··· |

| n | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | ··80 |
|---|---|---|---|---|---|---|---|---|---|---|---|---|---|---|---|---|---|---|---|---|---|---|---|---|---|---|---|---|---|
| FIRST HEATER | 1 | 0 | 0 | 0 | 0 | 0 | 0 | 1 | 0 | 0 | 0 | 0 | 1 | 0 | 0 | 0 | 1 | 0 | 0 | 0 | 1 | 0 | 1 | 0 | 1 | 0 | 1 | 0 | ··· |
| SECOND HEATER | 0 | 0 | 0 | 0 | 1 | 0 | 0 | 0 | 0 | 0 | 1 | 0 | 0 | 0 | 1 | 0 | 0 | 0 | 1 | 0 | 1 | 0 | 1 | 0 | 0 | 1 | 1 | 0 | ··· |

| n | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | ··n |
|---|---|---|---|---|---|---|---|---|---|---|---|---|---|---|---|---|---|---|---|---|---|---|---|---|---|---|---|---|---|
| FIRST HEATER | 1 | 0 | 0 | 0 | 1 | 0 | 0 | 0 | 0 | 0 | 1 | 0 | 1 | 0 | 0 | 0 | 1 | 0 | 1 | 0 | 0 | 0 | 1 | 0 | 1 | 0 | 0 | 0 | ··· |
| SECOND HEATER | 0 | 0 | 0 | 0 | 0 | 0 | 0 | 1 | 0 | 0 | 0 | 0 | 0 | 0 | 1 | 0 | 0 | 0 | 0 | 0 | 1 | 0 | 0 | 0 | 0 | 0 | 1 | 0 | ··· |

HEATING DEVICE AND IMAGE FORMING APPARATUS

CROSS-REFERENCE TO RELATED APPLICATIONS

This patent application is based on and claims priority pursuant to 35 U.S.C. §119(a) to Japanese Patent Application Nos. 2015-048196, filed on Mar. 11, 2015, and 2016-028927, filed on Feb. 18, 2016, in the Japan Patent Office, the entire disclosure of which is hereby incorporated by reference herein.

BACKGROUND

Technical Field

Embodiments of the present invention relate to a heating device and an image forming apparatus.

Description of the Related Art

Conventionally known is that an abrupt current flow through a fixing device included in an image forming apparatus results in a flow of incoming current causing a voltage fluctuation, which may cause flicker (flickering of illumination light) in an illumination device having a commercial power source in common with the image forming apparatus. Also known are: a phase control for avoiding an incoming current and a technology of performing discontinuous power distribution control for putting a frequency of the voltage fluctuation away from a frequency zone of the flicker easily perceived by human beings in order to reduce an influence of the flicker.

SUMMARY

In one aspect of the present invention, a heating device includes: a heater; and a power distribution controller. The heater heats a predetermined heating target. The power distribution controller controls supply of AC power to the heater. The power distribution controller performs power distribution to the heater in units of AC half wave, and controls the power supply to the heater in accordance with power distribution control patterns respectively corresponding to a first time period as a power distribution start period, a third time period as a power distribution stop period, and a second time period between the first time period and the third time period.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein:

FIGS. 2A, 2B, and 2C are diagrams illustrating examples of waveforms of AC half-wave controls used for a heater power distribution control;

FIG. 3A is a diagram illustrating an example of a transfer function imitating a response of a human visual system;

Figure 1:
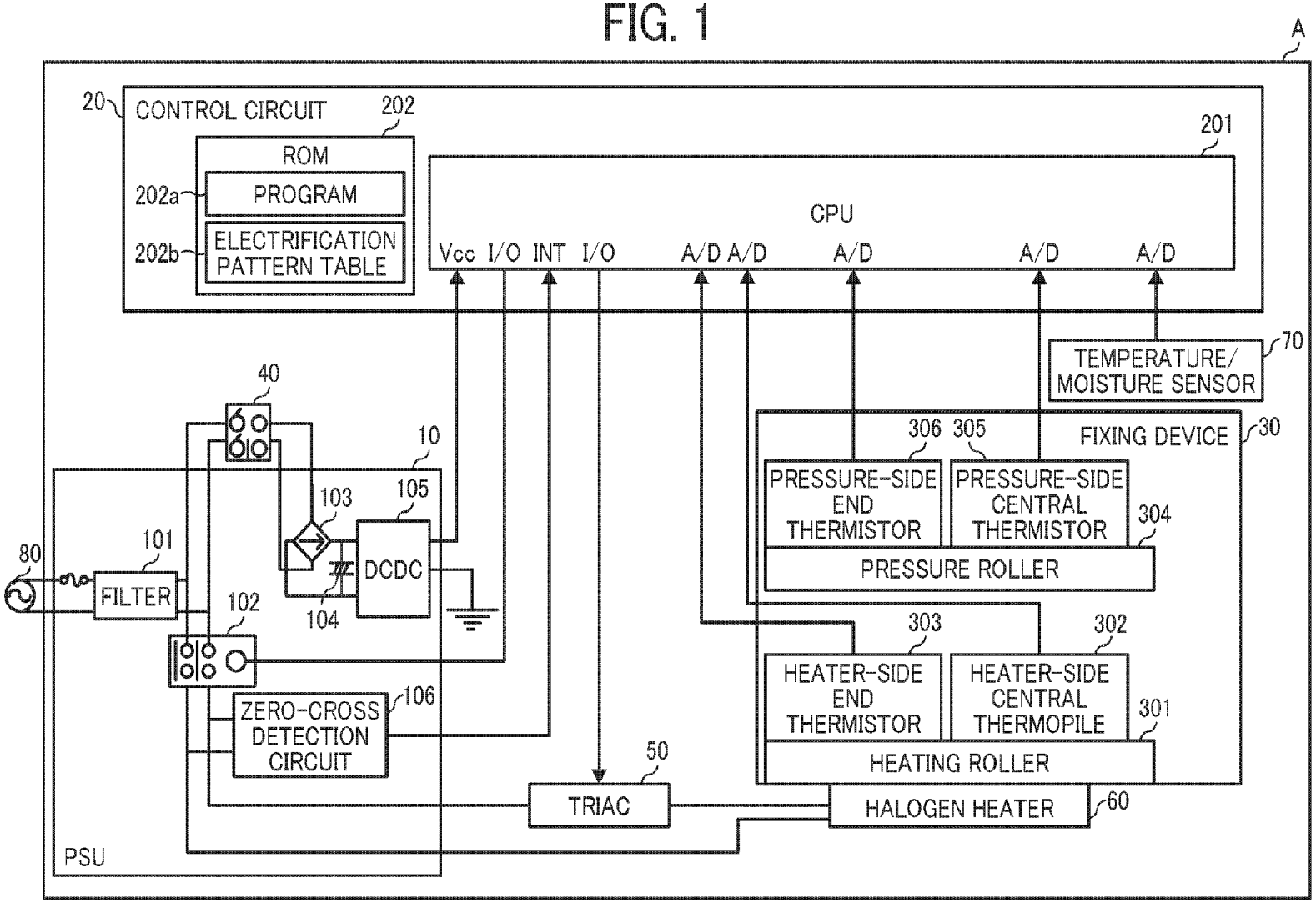
FIG. 1 is a hardware configuration diagram of an image forming apparatus according to a first embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the present disclosure is not intended to be limited to the specific terminology so selected and it is to be understood that each specific element includes all technical equivalents that operate in a similar manner.

First Embodiment: FIGS. 1 Through 15

Hereinafter, the first embodiment of the present invention will be described with reference to FIGS. 1 through 15.

First, FIG. 1 illustrates hardware configuration of an image forming apparatus A according to the first embodiment of the invention. FIG. 1 illustrates a portion related to a heating device of this embodiment of the invention.

The image forming apparatus A illustrated in FIG. 1 is an image forming apparatus which forms an image on paper based on input image data, and includes: a power supply unit (PSU) 10, a control circuit 20, a fixing device 30, a power supply switch 40, a triac 50, a halogen heater 60, and a temperature/humidity sensor 70.

The PSU 10 is a power supply device for supplying power from a commercial power source 80 as a power supply source, and includes: a filter 101, a relay 102, a rectifier diode 103, a smoothing capacitor 104, a switching type DC-DC converter (DCDC) 105, and a zero-cross detection circuit 106.

The power source switch 40 is a power source switch of the image forming apparatus A, and when the power source switch 40 is turned on, power is supplied from the commercial power source 80 to the PSU 10.

The control circuit 20 is a circuit including a function of controlling the image forming apparatus A, and includes: at least a central processing unit (CPU) 201 as a controller; and a read-only memory (ROM) 202 as a storage section. Stored in the ROM 202 are, for example, a program 202*a* and a power distribution pattern table 202*b* for performing a heater control.

The fixing device 30 is a device which fixes an image formed on a recording medium at time of image formation performed by the image forming apparatus A, and includes: a heating roller 301, a heater-side central thermopile 302, a heater-side end thermistor 303, a pressure roller 304, a pressure-side central thermistor 305, and a pressure-side end thermistor 306. The heating roller 301 applies heat to the image formed on the recording medium to fix the image thereon.

Moreover, the heating roller 301 can be heated by the halogen heater 60, which is disposed closely to the fixing device 30 to maintain its surface temperature at a predetermined fixing temperature.

The triac 50, which is one example of a semiconductor switching element, permits current flow in both directions, and has a function of varying an ON time period for each half wave length of an alternating-current (AC) power to thereby control current supply. The triac 50 is provided between the control circuit 20 and the fixing device 30, and controls power distribution to the halogen heater 60 in accordance with the power distribution pattern table 202*b* stored in the ROM 202 of the control board 20.

The halogen heater 60 is disposed closely to the heating roller 301 of the fixing device 30, and heats the heating roller 301 as a heating target. The heater-side central thermopile 302 and the heater-side end thermistor 303 function as temperature detection elements for the heating roller 301, and detect a temperature of the heating roller 301.

On the other hand, the pressure-side central thermistor 305 and the pressure-side end thermistor 306 function as temperature detection elements for the pressure roller 304, and detect a temperature of the pressure roller 304.

The temperature/moisture sensor 70 is a sensor which detects an environment temperature inside the image forming apparatus A, and functions as an environment temperature detector.

Next, example operation of controlling a temperature of the halogen heater 60, performed by the image forming apparatus A, is described.

First, when the power source switch 40 of the image forming apparatus A has been turned on, noise of a current supplied from the commercial power source 80 is first removed by the filter 101 provided in the PSU 10, then smoothened by the rectifier diode 103 and the smoothing capacitor 104, and supplied to the DCDC 105. The DCDC 105 supplies a low voltage Vcc to the control circuit 20.

On the other hand, an AC current is supplied to the zero-cross detection circuit 106. A voltage of the AC current becomes close to zero every half-wave length, and thus the voltage cannot be held while a transistor of the zero-cross detection circuit 106 is turned on.

Thus, the zero-cross detection circuit 106 detects a state of this transistor, that is, detects a zero-cross point of the commercial power source 80, and outputs a zero-cross signal to the control circuit 20. The control circuit 20 performs an on-off control of the triac 50 in accordance with this zero-cross signal.

Using this, the image forming apparatus A, in accordance with a power distribution pattern stored in the power distribution pattern table 202*b*, executes a power distribution control of controlling supply of the AC power to the halogen heater, thereby making it possible to control the temperature of the halogen heater 60.

The image forming apparatus A is capable of controlling the power distribution to the halogen heater 60 included in the fixing device 30 based on units of AC half-waves (AC half-wave control).

The AC half-wave control will be first described with reference to FIGS. 2A, 2B, and 2C (FIG. 2).

FIGS. 2A, 2B, and 2C respectively illustrate waveforms of a two half-wave control, a three half-wave control, and a four half-wave control, as an example of waveforms used for the AC half-wave control. Here, any portion painted in black indicates that the heater is on, that is, a power-distributed portion. Any portion not painted (dotted portion) indicates that the heater is off, that is, a non-power-distributed portion. The following waveforms are illustrated with on-portions and off-portions discriminated in a similar manner.

As illustrated in FIG. 2A, in the two half-wave control, the power distribution to the heater is performed for a period corresponding to one of two half-wave lengths while the power distribution to the heater is stopped for a next period corresponding to the other one half-wave length. In the three half-wave control of FIG. 2B, the power distribution to the heater is performed for a period corresponding to one of three half-wave lengths while the power distribution to the heater is stopped for a next period corresponding to the other two half-wave lengths. Similarly, in an N-number half-wave control, the power distribution to the heater is performed for a period corresponding to one of an N-number of half-wave lengths while the power distribution to the heater is stopped for a next period corresponding to an (N−1)-number of half-wave lengths.

At this point, where a frequency of the commercial power source 80 is 50 Hz, a period required for the half-wave length is 10 ms (milliseconds), and where the frequency of the commercial power source 80 is 60 Hz, the period required for the half-wave length is 8.35 ms.

The PSU 10 performs discontinuous power distribution by use of such AC half-wave controls to perform a control of the power distribution to the heater. However, an incoming current at time of power distribution start raises a problem that flicker occurs.

The flicker refers to, for example, in a case where an illumination device and a heating device have a common power source, flickered illumination due to a fluctuation in an illumination voltage caused by the incoming current in the power distribution start period.

Next, with reference to FIGS. 3A through 3C, a technique of evaluating how strongly human eyes recognize this flicker will be described.

Figure 3B:
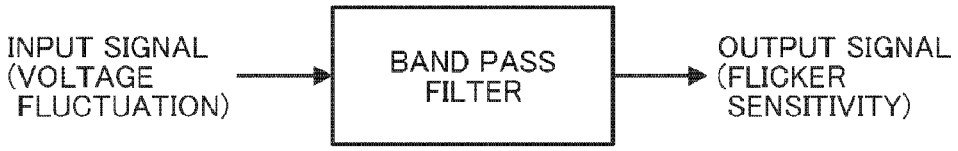
FIG. 3B is a diagram illustrating input into and output from a band pass filter.
Figure 3C:
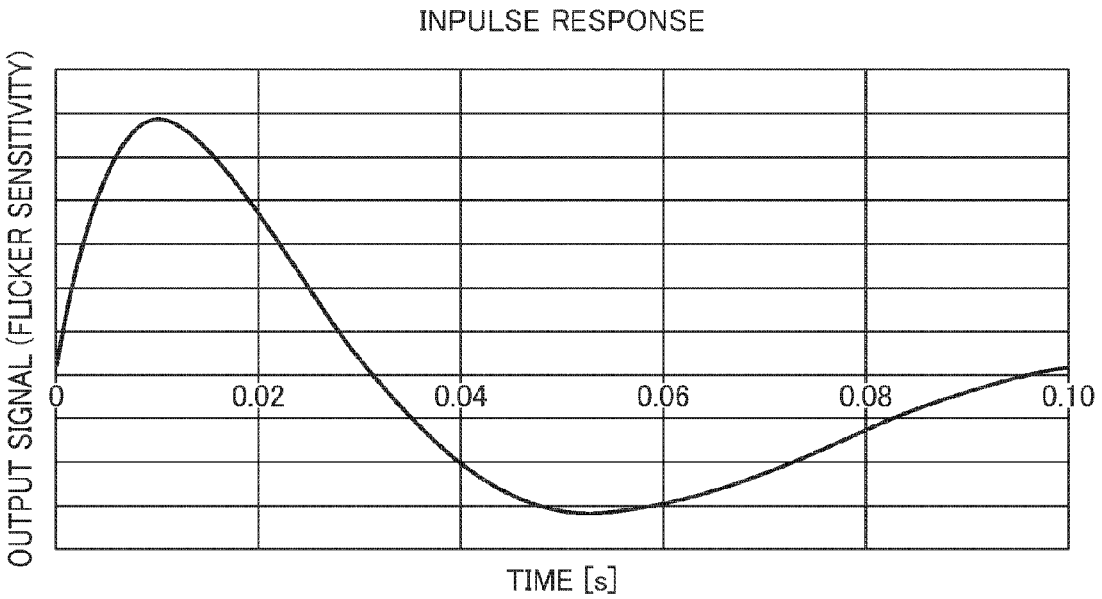
FIG. 3C is a diagram illustrating an output response waveform in a case where a unit impulse is input into a band filter having the transfer function of FIG. 3A.

FIG. 3A is a transfer function simulating a response of a human visual system. As illustrated in FIG. 3B, an output signal obtained by adding, to a band pass filter having the transfer function of FIG. 3A, an input signal indicating the voltage fluctuation attributable to the flicker serves as a signal indicating a degree of flicker (flicker sensitivity) recognized by the human eyes.

As a reference example, FIG. 3A illustrates a waveform of an output response in a case where a unit impulse is input to the band pass filter having the transfer function. The larger amplitude of this output signal is, the greater the degree of flicker recognized by the human eyes is, and thus it can be said that it is desirable to control to reduce the amplitude of this output signal.

Figure 4:
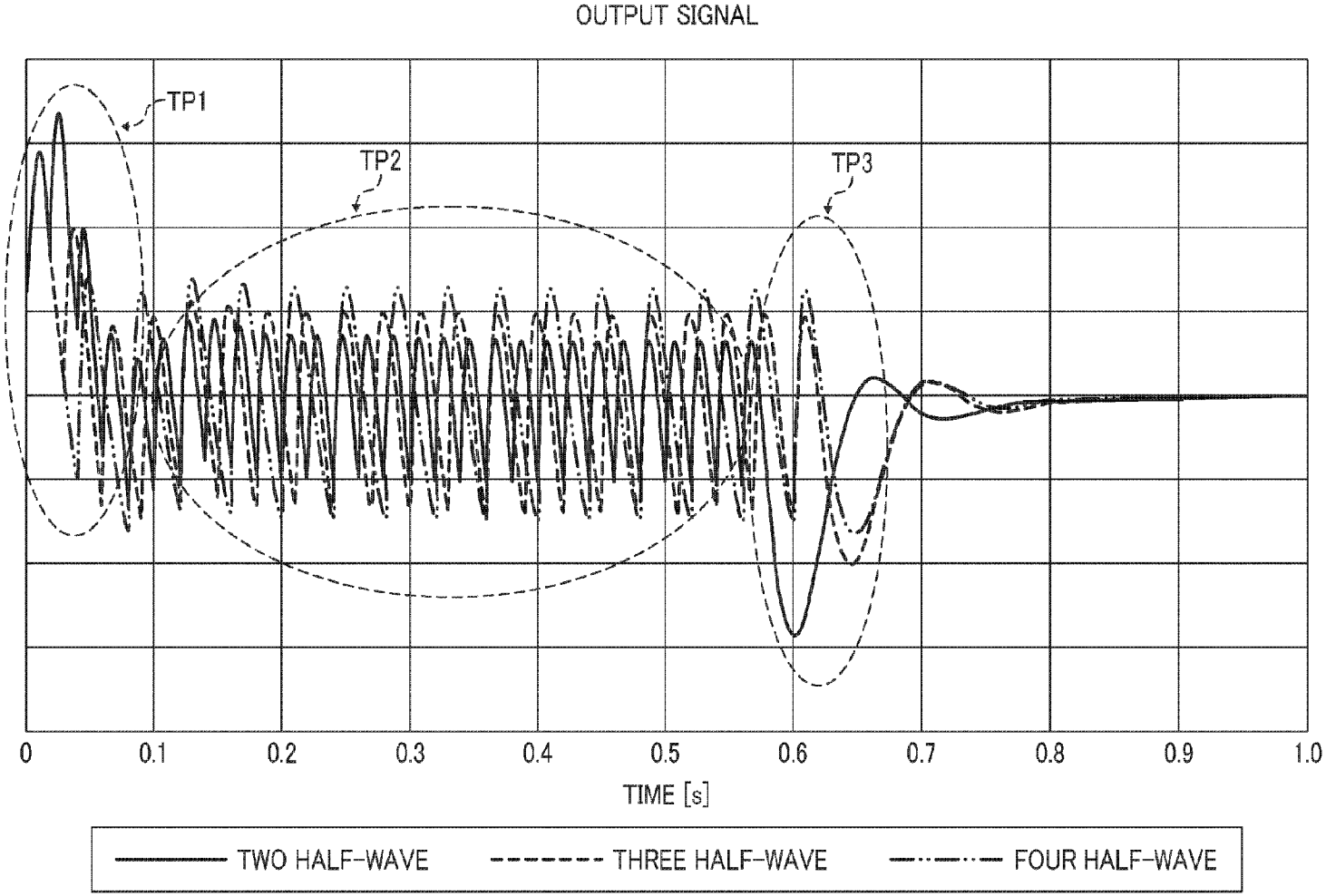
FIG. 4 is a diagram illustrating a waveform obtained by superposing impulse response output signals outputted at time of power distribution under two half-wave control, three-half-wave control, and four half-wave control.

Here, the flicker sensitivity in a case where the power distribution to the heater is performed by use of the two half-wave control, the three half-wave control, and the four half-wave control described in FIG. 2 is simulated by use of the transfer function of FIG. 3A. FIG. 4 shows results of this simulation. The simulation is performed based on an assumption that the power source is at 50 Hz and the power distribution is stopped after passage of a given period since power distribution start.

First, a solid line indicates a waveform of superimposed impulse responses obtained in a case where impulses are provided at intervals of 20 ms to the transfer function of FIG. 3A in conjunction with the two half-wave control (power distribution per 20 ms).

A dotted line indicates a waveform similarly obtained in a case where impulses are provided at intervals of 30 ms in conjunction with the three half-wave control (power distribution per 30 ms).

A double-dot-dash line indicates a waveform obtained in a case where impulses are provided at intervals of 40 ms in conjunction with the four half-wave control (power distribution per 40 ms).

The waveforms in the graph are largely divided into three time periods in view of their forms. These time periods are: a heater power distribution start period (first time period TP1), a heater power distribution steady-state period (second time period TP2), and a heater power distribution stop period (third time period TP3).

Comparing the different half-wave controls during each time period proves that an absolute value of the output signal is large in the two half-wave control in the heater power distribution start period (TP1) and the heater power distribution stop period (TP3) and that an absolute value of the output signal is large in the four half-wave control in the heater power supply steady-state period (TP2). Conversely, it also proves that an absolute value of the output signal is small in the four half-wave control in the heater power distribution start period (TP1) and the heater power distribution stop period (TP3) and that an absolute value of the output signal is small in the two half-wave control in the heater power distribution steady-state period (TP2).

Thus, the simulation results of FIG. 4 prove that, for each of the three time periods described above, performing power distribution controls by use of power distribution control patterns of the AC half-waves such that absolute values of the output signals of the impulse responses become small can reduce the flicker.

Based on the above, in this embodiment, for each of the three time periods, the power distribution to the heater is performed by use of the half-wave control appearing to be optimum. Referring to the example of FIG. 4, it is possible that the four half-wave control is performed in the first time period TP1 and the third time period TP3 and the two half-wave control is performed in the second time period TP2.

Hereinafter, some examples of the controls of power distribution to the halogen heater 60 in accordance with this idea will be described. In the image forming apparatus A, only one of these controls may be adopted, or some may be switched therebetween.

First, the first example of the power distribution control will be described.

Figure 5:
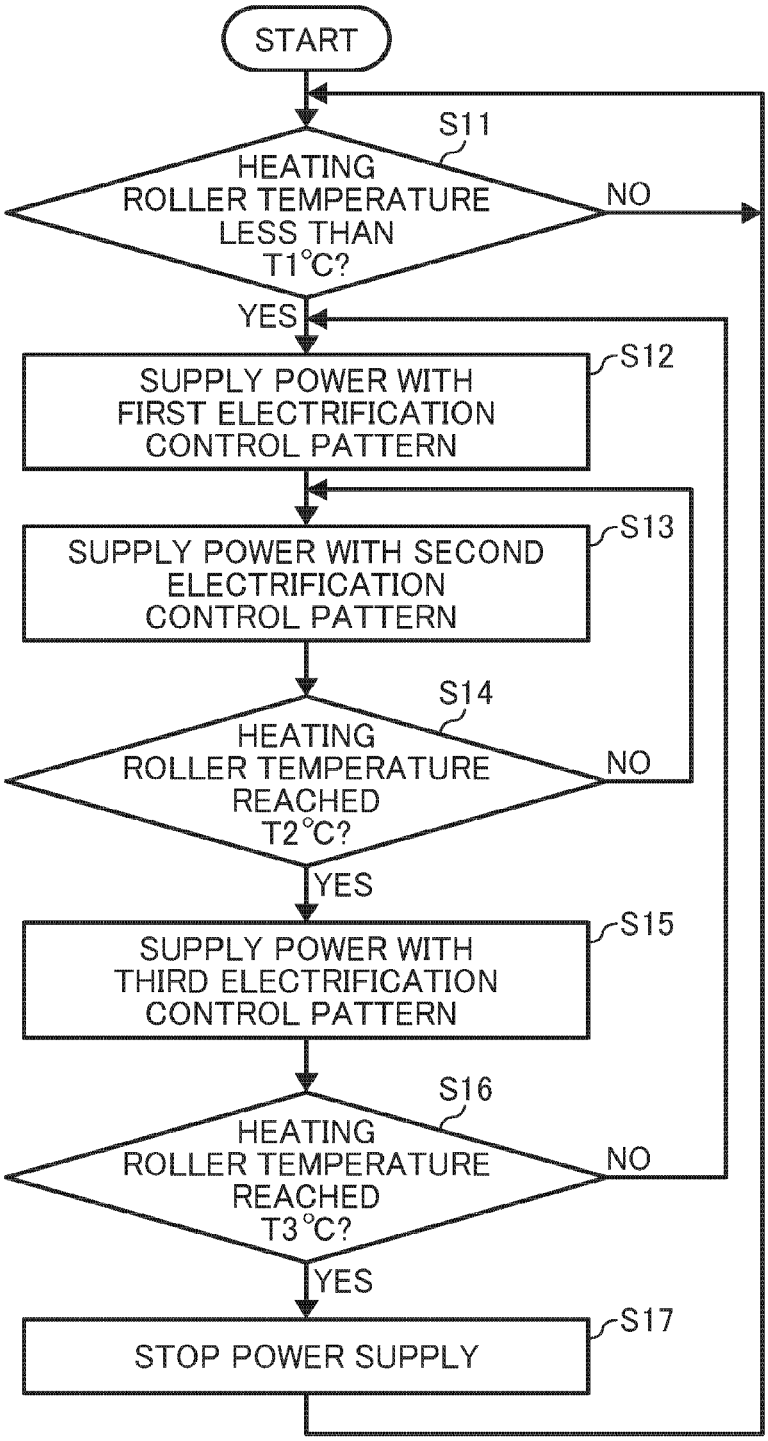
FIG. 5 is a flowchart illustrating operation of controlling power distribution to a halogen heater, performed by the image forming apparatus of FIG. 1, according to a first example.

FIG. 5 is a flowchart of the power distribution control executed by the CPU 201 in this first example. Note that expression "distribute (supply) power with . . . power distribution control pattern" illustrated in the flowchart of FIG. 5 indicates processing of switching on and off of the triac 50 so that the power distribution to the halogen heater 60 can be performed at a timing in accordance with the corresponding power distribution control pattern based on a result of the zero-cross detection circuit 106. The same applies to processing illustrated in flowcharts below.

The CPU 201 starts the processing illustrated in the flowchart of FIG. 5 in cases where the fixing device 30 needs to be put into a state in which it is usable for image formation, for example, when the power source of the image forming apparatus A has been turned on or when the image forming apparatus A has recovered from a sleep state.

Then first, the CPU 201 detects the temperature of the heating roller 301, and determines whether or not this temperature is less than preset T1 degrees Celsius (heating start temperature) (S11). Here, a temperature detected by the heater-side central thermopile 302 is used as a temperature of the fixing device 30, but a temperature detected by any other sensor or an average or a weighing average of temperatures detected by a plurality of sensors may be used.

T1 is a heating start temperature in a term such that reheating starts upon a temperature decrease down to T1 after the heating roller 301 is once sufficiently heated, and it is assumed that upon start of the processing of FIG. 5, heating starts with a temperature lower than T1.

Then if the temperature is equal to or higher than T1 degrees Celsius in step S11, it is waited until the temperature falls less than T1 degrees Celsius, but if the temperature is less than T1 degrees Celsius, the CPU 201 performs power distribution to the halogen heater 60 with a first power distribution control pattern (S12). The first power distribution control pattern is a power distribution control pattern used in the first time period TP1 as the power distribution start period, and is a pattern for the four half-wave control under condition of FIG. 4. A control in accordance with this first power distribution control pattern ends in a previously defined period. A duration or a number of continued half waves may be defined for the pattern itself.

After the power distribution of step S12, the CPU 201 continues to perform the power distribution to the halogen heater 60 with a second power distribution control pattern (S13). This second power distribution control pattern is a power distribution control pattern used in the second time period TP2, and is a pattern for the two half-wave control under the condition of FIG. 4. For a control in accordance with the second power distribution control pattern, there is no time limitation.

Then the CPU 201 continues the power distribution with the second power distribution control pattern until the temperature of the heating roller 301 reaches T2 degrees Celsius. T2 indicates a target temperature serving as a threshold value for shifting to a power distribution stopping control, and may be set at a value equal to or a little lower than T3 as a target temperature for heating the heating roller 301.

Then upon the reach of the temperature of the heating roller 301 at T2 degrees Celsius (Yes in S14), the CPU 201 switches the power distribution control pattern to a third power distribution control pattern and performs the power distribution to the halogen heater 60 (S15). The third power distribution control pattern is a power distribution control pattern used in the third time period TP3 as the power distribution stopping period, and is a pattern for the four half-wave control pattern under the condition of FIG. 4. A control in accordance with this third power distribution control pattern, as is the case with the control in accordance with the first power distribution control pattern, ends in a previously defined period. A duration or a number of continued half waves may be defined for the pattern itself.

After the power distribution of step S15, the CPU 201 determines whether or not the temperature of the heating roller 301 has reached T3 degrees Celsius (S16). T3 is a temperature which can be reached as a result of performing the power distribution with the third power distribution control pattern from a time point of the temperature T2 (T2 is set according to such a reference based on desired T3), and thus the determination in step S16 is usually Yes. However, if No due to insufficient heating for some reason, the CPU 201 returns to step S12 and repeats the processing, and further performs the power distribution to the halogen heater 60 to additionally heat the heating roller 301.

If T3 degrees Celsius has been reached (Yes in S16), the CPU 201 stops the power distribution to the halogen heater 60 (S17), and returns to step S11. Then at a time point at which the temperature of the heating roller 301 has fallen to T1, the CPU 201 restarts heating.

The CPU 201 continues the processing of FIG. 5 until maintaining the state in which the fixing device 30 can be used for image formation is no longer required, for example, until shifting to a power-saving mode occurs, and when maintaining the state in which the fixing device 30 can be used for image formation is no longer required, the CPU 201 stops the processing of FIG. 5 at an appropriate time point.

The target temperatures T1 to T3 are previously calculated through, for example, an experiment or simulation, and stored into a storage area such as the ROM 202. Different values may be provided in accordance with settings (paper kind, size, image formation speed, etc.) used for the image formation.

In the processing of FIG. 5, the CPU 201 functions as a power distribution controller.

In the processing of FIG. 5, the determination in step S16 can be omitted, and the processing may proceed to step S17 immediately after step S15.

In the processing of FIG. 5, the CPU 201 performs the power distribution to the halogen heater 60 based on the units of AC half-waves, and controls power supply to the halogen heater 60 in accordance with the power distribution control patterns corresponding to the respective time periods, i.e. the first time period TP1 as the power distribution start period, the third time period TP3 as the power distribution stopping period, and the second time period TP2 between the first time period TP1 and the third time period TP3. Then this can more reduce the degree of flicker recognized by the human eyes, compared to that in a case where the power supply is controlled with the uniform power distribution control pattern in all the power distribution time periods.

Moreover, upon the reach of the temperature of the heating roller 301 at the target temperature T2, the CPU 201 shifts to the power distribution control in the third time period TP3 after ending the power distribution control in the second time period TP2, which can therefore easily perform a temperature control in view of the flicker reduction in the power distribution stopping period.

Moreover, when the heating roller 301 has turned to the heating start temperature T1 lower than the target temperature T3, the CPU 201 starts the power distribution to the halogen heater 60, which can therefore reduce a number of times of half-wave control carried out by use of temperature hysteresis and thereby suppress the flicker.

Next, the second example of the power distribution control will be described.

Figure 6:
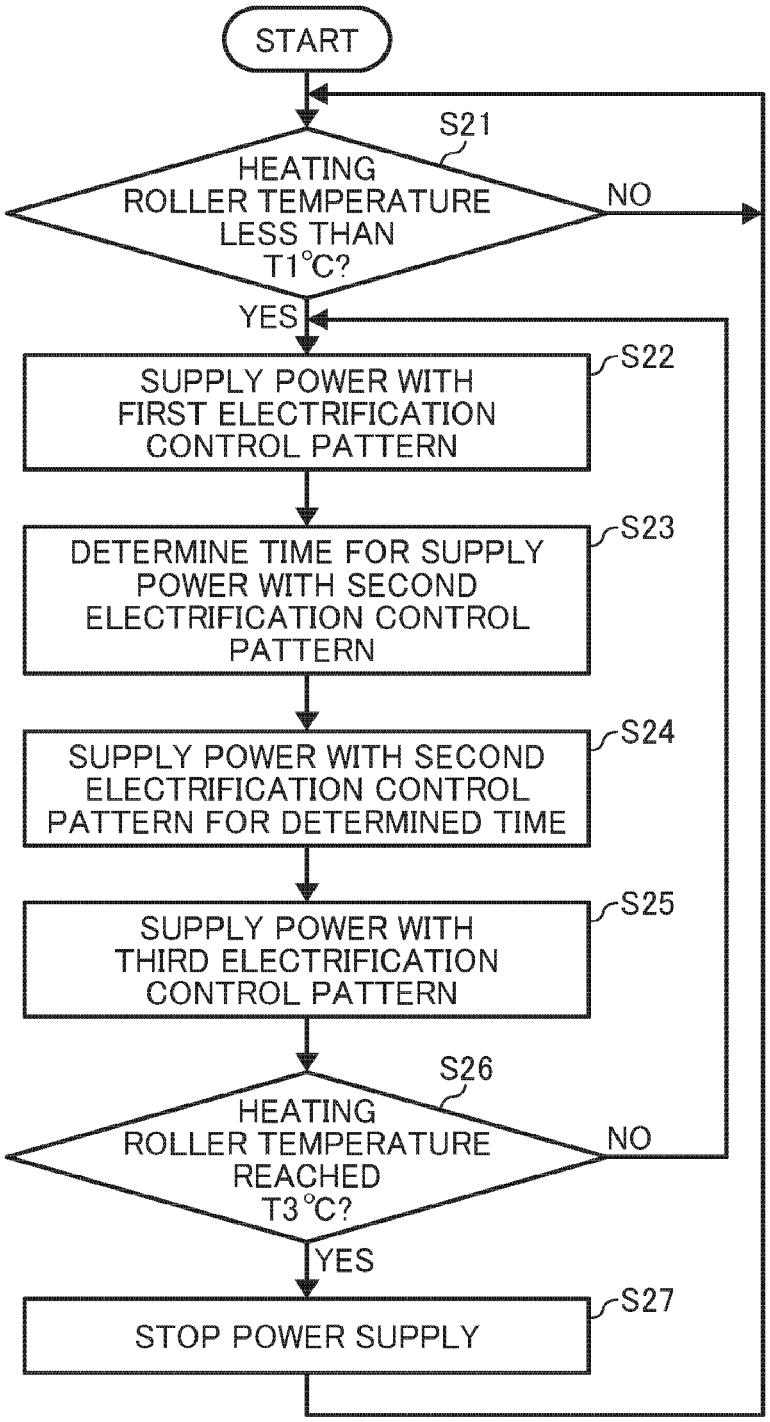
FIG. 6 is a flowchart illustrating operation of controlling power distribution to a halogen heater, performed by the image forming apparatus of FIG. 1, according to a second example.

FIG. 6 illustrates, in correspondence with FIG. 5, a flowchart of power distribution control processing executed by the CPU 201 in this second example.

This processing of FIG. 6 differs from FIG. 5 in a point that a period for which the power distribution is performed with the second power distribution control pattern is previously defined before the power distribution, and thus the description will focus on this point.

First, processing start condition and step S21 are same as those in step S11 of FIG. 5, and in a case where the temperature of the heating roller 301 is less than T1 degrees Celsius, the CPU 201 first starts the power distribution to the halogen heater 60 with the first power distribution control pattern (S22).

Next, the CPU 201 determines the period for which the power distribution to the halogen heater 60 is performed with the second power distribution control pattern (S23). It is possible to obtain this period by, for example, obtaining, based on a difference between the current temperature of the heating roller 301 and the target temperature T3, an amount of heat to be given for heating the heating roller 301 up to the target temperature T3, and then dividing this amount of heat with an amount of heat which can be given per unit time through the power distribution with the second power distribution control pattern. Moreover, from this obtained period, a period for which the power distribution to the halogen heater 60 is performed with the third power distribution control pattern may be subtracted. At this stage of heat quantity, an amount of heat given to the heating roller 301 through the power distribution with the third power distribution control pattern may be subtracted.

In any case, the CPU 201 performs the power distribution to the halogen heater 60 with the second power distribution control pattern for the period determined in step S23 (S24). Then power distribution to the halogen heater 60 is performed with the third power distribution control pattern (S25).

Then the CPU 201 determines whether or not the temperature of the heating roller 301 has reached T3 degrees Celsius as a result of the power distribution performed up to this point (S26). If T3 degrees Celsius has been reached, the CPU 201 stops the power distribution to the halogen heater 60 (S27), and returns to step S21. Then at a time point at which the temperature of the heating roller 301 has fallen to T1, the CPU 201 restarts heating. Conversely, if T3 degrees Celsius has not yet been reached, the CPU 201 returns to step S22 to repeat the processing, and additionally heats the heating roller 301 through further power distribution to the halogen heater 60.

Also through the processing of FIG. 6 described above, the CPU 201 can reduce the degree of flickering recognized by the human eyes, as is the case with the processing of FIG. 5.

Next, as a modified example of the second example, processing of adjusting the period of the power distribution with the second power distribution control pattern (period of power distribution in the second time period) will be described with reference to FIGS. 7 and 8. The processing illustrated in FIGS. 7 and 8 is executed after step S23 of FIG. 6 and before step S24 of FIG. 6.

Figure 7:
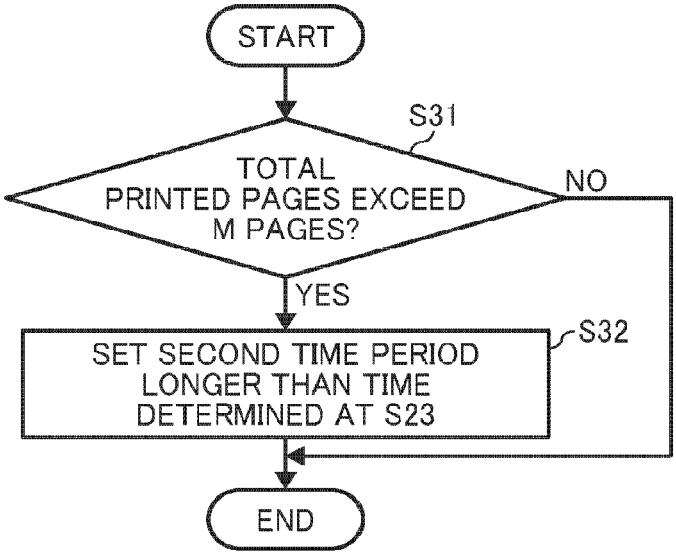
FIG. 7 is a flowchart illustrating operation of adjusting a period of power distribution in a second time period in a case where the halogen heater of the image forming apparatus is subjected to time degradation.
Figure 8:
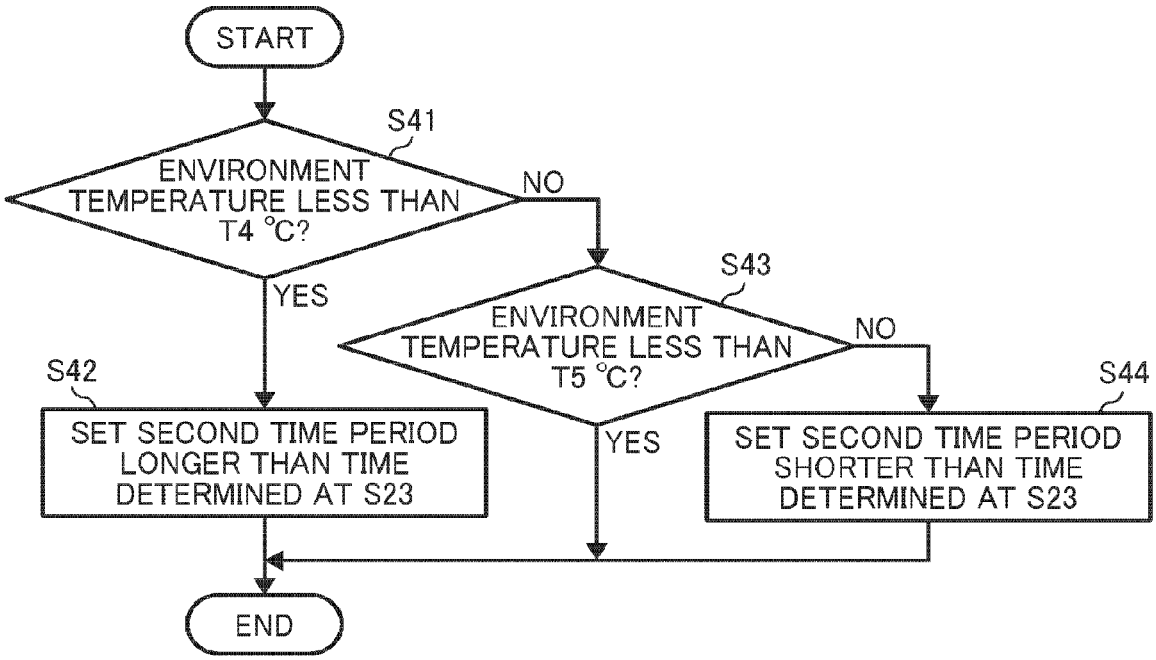
FIG. 8 is a flowchart illustrating operation of adjusting the period of power distribution to the halogen heater in the second time period in accordance with the environment temperature of the image forming apparatus.

First, in the processing of FIG. 7, if a total number of printed pages in the image forming apparatus A has exceeded an M-number of pages (Yes in S31), the period for which the power distribution is performed with the second power distribution control pattern is set longer than the period determined in step S23 (S32). On the other hand, if No in step S31, the processing ends without changing the period of power distribution in the second time period TP2.

Typically, upon time degradation of the halogen heater 60 due to use of the halogen heater 60, an amount of heat per given period which can be supplied to the fixing device 30 with the same output decreases. Thus, following the time degradation, it is required to increase the period of power distribution.

Here, a degree of time degradation of the halogen heater 60 is estimated with reference to the total number of pages printed by the image forming apparatus A, and based on results of this estimation, the period of power distribution with the second power distribution control pattern is adjusted. This may be performed by the CPU 201. Then, where the M-number of printed pages is defined as a threshold value, upon excess over this value, the period of power distribution is extended. As a result, even upon the time degradation of the halogen heater 60, on and off of the power distribution is no longer repeated as a result of No in step S26 of FIG. 6, which can appropriately reduce the flicker.

Next, the processing of FIG. 8 changes the period of the power distribution with the second power distribution control pattern in accordance with the environment temperature of the image forming apparatus A. This environment temperature can be detected by the temperature/moisture sensor 70.

In the processing of FIG. 8, if the environment temperature is equal to or lower than a preset temperature T4 degrees Celsius (Yes in S41), the CPU 201 sets the period of the power distribution with the second power distribution control pattern longer than the period of power distribution determined in step S23 (S42), and ends this processing.

If No in step S41, if the environment temperature is equal to or lower than T5 degrees Celsius (Yes in S43), the CPU 201 ends the processing of FIG. 8 without changing the second power distribution control pattern.

On the other hand, if No in step S43, the CPU 201 sets the period of the power distribution with the second power distribution control pattern shorter than the period of power distribution determined in step S23 (S44), and ends the processing of FIG. 8.

Here, typically speaking, if the environment temperature inside the image forming apparatus A is low, a period required until the halogen heater 60 supplies a necessary amount of heat to the fixing device 30 becomes longer. On the other hand, the higher the environment temperature is, the shorter this period is.

Therefore, in step S23 of FIG. 6, the period of power distribution is determined based on the amount of heat to be supplied to the halogen heater 60 at a normal environment temperature (e.g., about 25 degrees Celsius), and this period of power distribution is preferably adjusted in accordance with the environment temperature.

As a result, even at a low environment temperature, on and off of the power distribution is no longer repeated as a result of No in step S26 of FIG. 6, which can appropriately reduce the flicker. Moreover, a high environment temperature does not result in excessive heating.

Note that, instead of the three stages as in FIG. 8, relationship between the environment temperature and a degree of adjustment of the period of power distribution obtained in step S23 may be stored in, for example, the ROM 202 as appropriate so that the amount of adjustment corresponding to the environment temperature can be read for application.

Next, with reference to FIGS. 9A through 14B, power distribution control patterns different from those of the aforementioned example corresponding to the first time period TP1, the second time period TP2, and the third time period TP3, respectively, will be described. The power distribution control patterns described below are applicable to both the first and second examples of power distribution control.

Figure 9A:
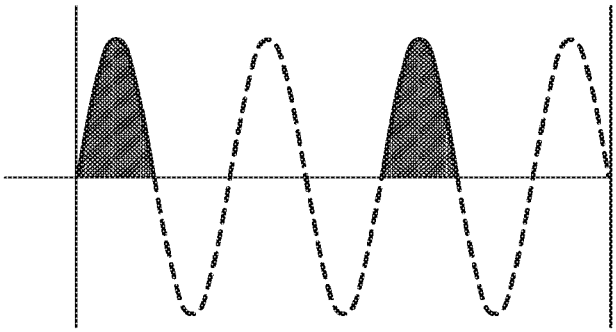
FIG. 9A is a diagram illustrating a preferable first power distribution control pattern waveform where a frequency of a commercial power source is 50 Hz.
Figure 9B:
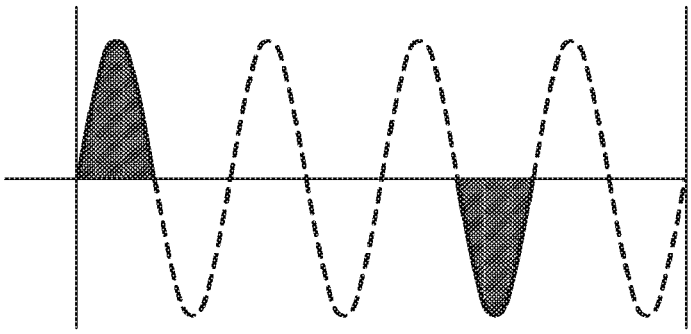
FIG. 9B is a diagram illustrating a preferable first power distribution control pattern waveform where a frequency of a commercial power source is 60 Hz.

First, as illustrated in FIGS. 9A and 9B, for the first power distribution control pattern in the first time period TP1, it is possible that the first power distribution control pattern is prepared for each frequency of the commercial power source 80 and any of those is selected for use in accordance with the frequency of the commercial power source 80 to which the image forming apparatus A is connected.

FIG. 9A shows a preferable waveform of the first power distribution control pattern where the commercial power source is at 50 Hz. FIG. 9B shows a preferable waveform of the first power distribution control pattern where the commercial power source is at 60 Hz. The pattern illustrated in FIG. 9A is a power distribution control pattern with which the three half-wave control is carried out after the four half-wave control is carried out, and the pattern illustrated in FIG. 9B is a pattern with which the three half-wave control is carried out after a five half-wave control is carried out.

Figure 10:
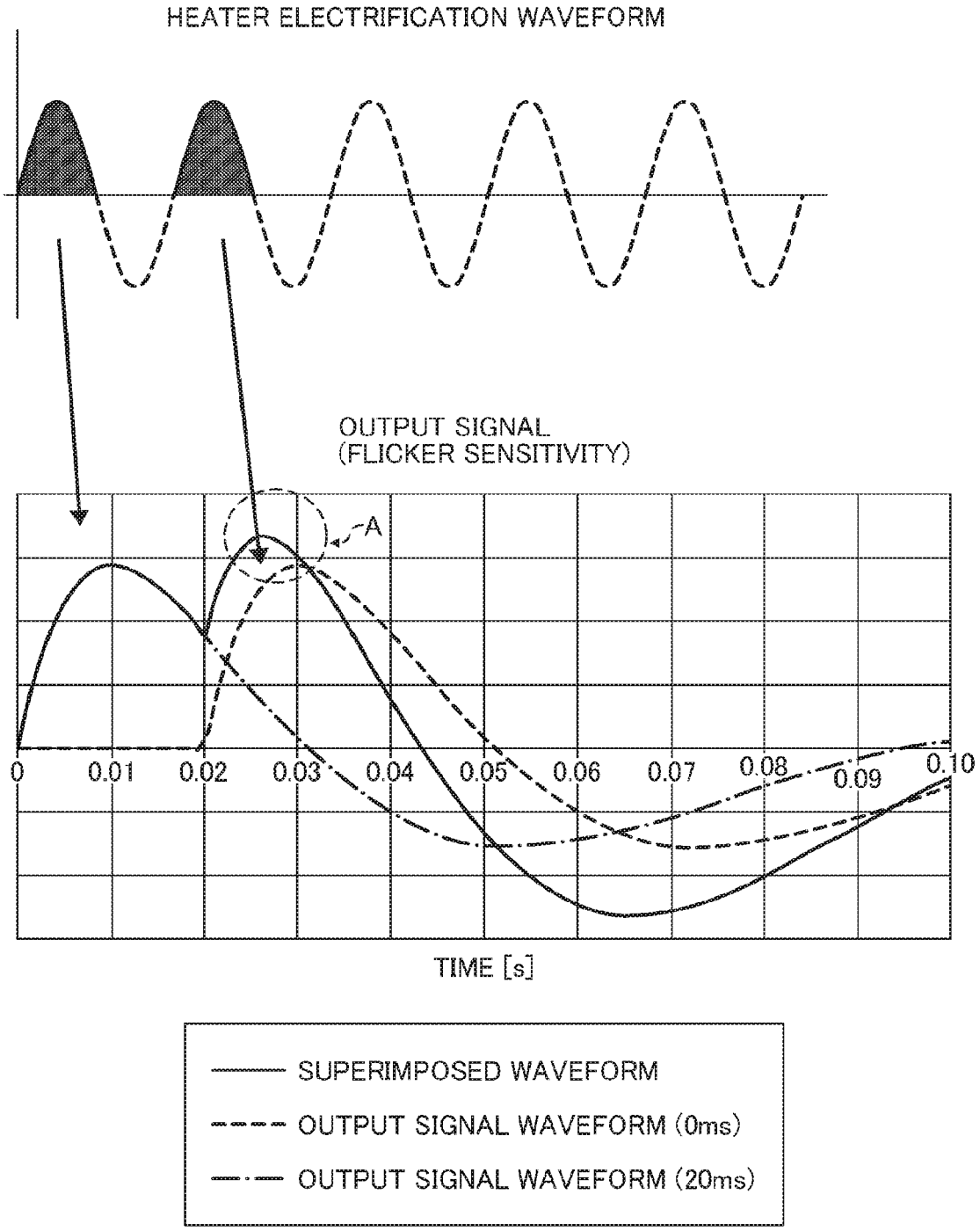
FIG. 10 is a diagram illustrating an output signal waveform as a simulation result for the power distribution under the two-half-wave control.

These patterns are obtained by generating, by use of the filter of FIG. 3B, combinations of various number of half-wave control patterns and corresponding impulse responses under each frequency condition and one of those with a small amplitude of the flicker sensitivity in the power distribution start period is selected for use First, FIG. 10 shows an example of flicker sensitivity obtained upon power distribution under the two half-wave control.

Illustrated in the example of FIG. 10 are, on a basis of assumption that the two half-wave control is performed at 50 Hz, output results of impulse responses for virtual impulses accordingly input into the filter of FIG. 3B at timing of 0 ms and 20 ms.

A waveform of an output signal of the impulse response for a signal input at the timing of 0 ms is illustrated by a dotted line, a waveform of an output signal of the impulse response for a signal input at the timing of 20 ms is illustrated by a dot-dash line, and a waveform of these superimposed one on a top of another is illustrated by a solid line. Then it is proved that, in a zone between 20 ms and 30 ms (a portion illustrated by A in FIG. 10), the two impulse responses (output signals) are added together and amplified, resulting in greater flicker sensitivity.

Figure 11:
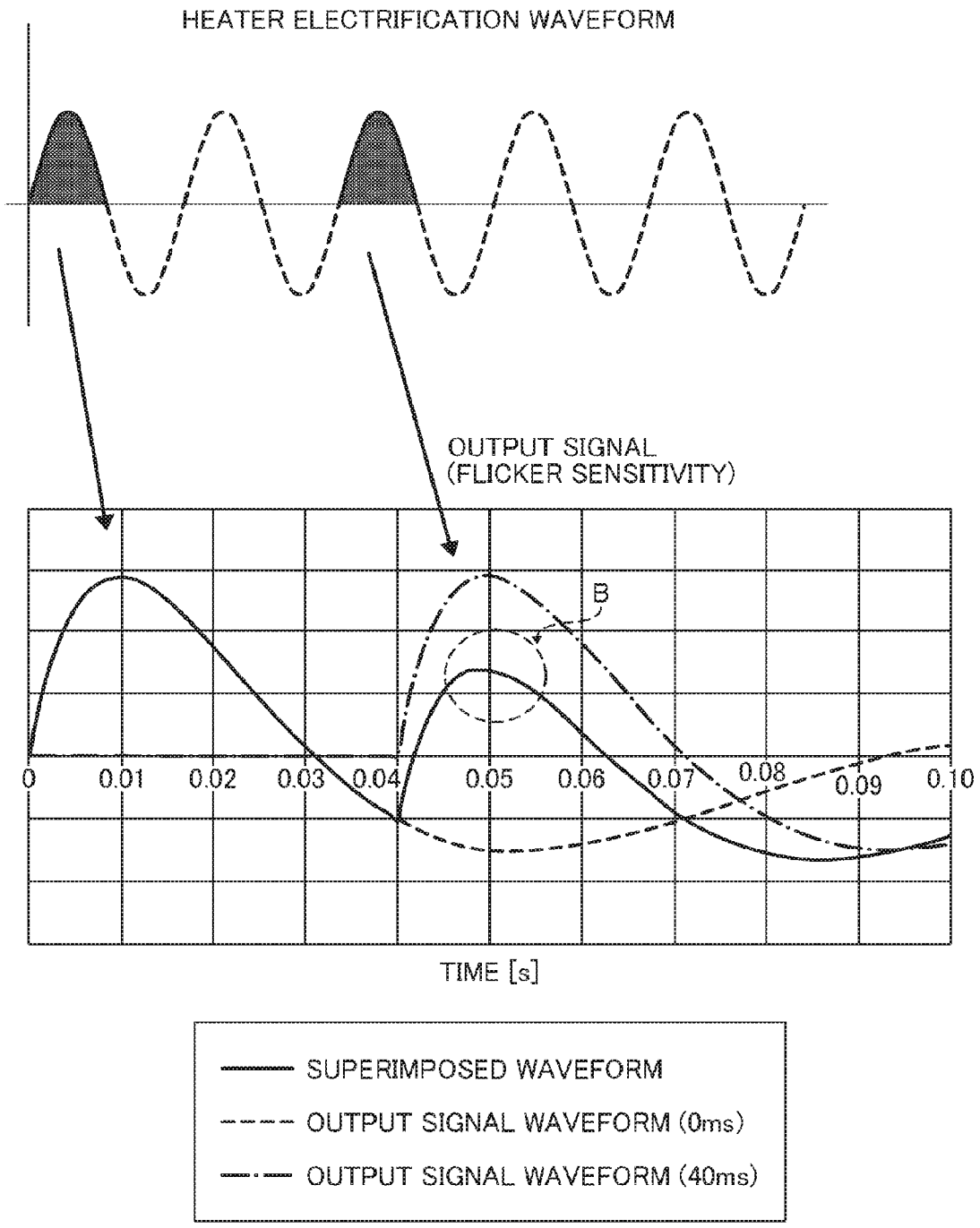
FIG. 11 is a diagram illustrating an output signal waveform as a simulation result for the power distribution under the four-half-wave control.

Next, FIG. 11 shows an example of flicker sensitivity obtained upon power distribution under the four half-wave control.

Illustrated in the example of FIG. 11 is, on a basis of assumption that the four half-wave control is performed at 50 Hz, output results of impulse responses for virtual impulses accordingly input into the filter of FIG. 3B at timing of 0 ms and 40 ms.

A waveform of an output signal of the impulse response for a signal input at the timing of 0 ms is illustrated by a dotted line, a waveform of an output signal of the impulse response for a signal input at the timing of 40 ms is illustrated by a dot-dash line, and a waveform of these superimposed one on a top of another is illustrated by a solid line. Then it is proved that, in a zone between 40 ms and 50 ms (a portion illustrated by B in FIG. 11), the two impulse responses cancel each other, resulting in smaller flicker sensitivity.

As described above, in accordance with the number of half-waves of the half-wave control, a synthetic value of the flicker sensitivities in accordance with a plurality of times of power distribution varies. Then combinations of various numbers of half-waves and corresponding impulse responses are obtained in accordance with condition of each frequency, and one of those with a small amplitude of the flicker sensitivity in the power distribution start period can be selected for use in the power distribution control. This can reduce the flicker under optimum condition in accordance with the frequency of the commercial power source 80.

Figure 12A:
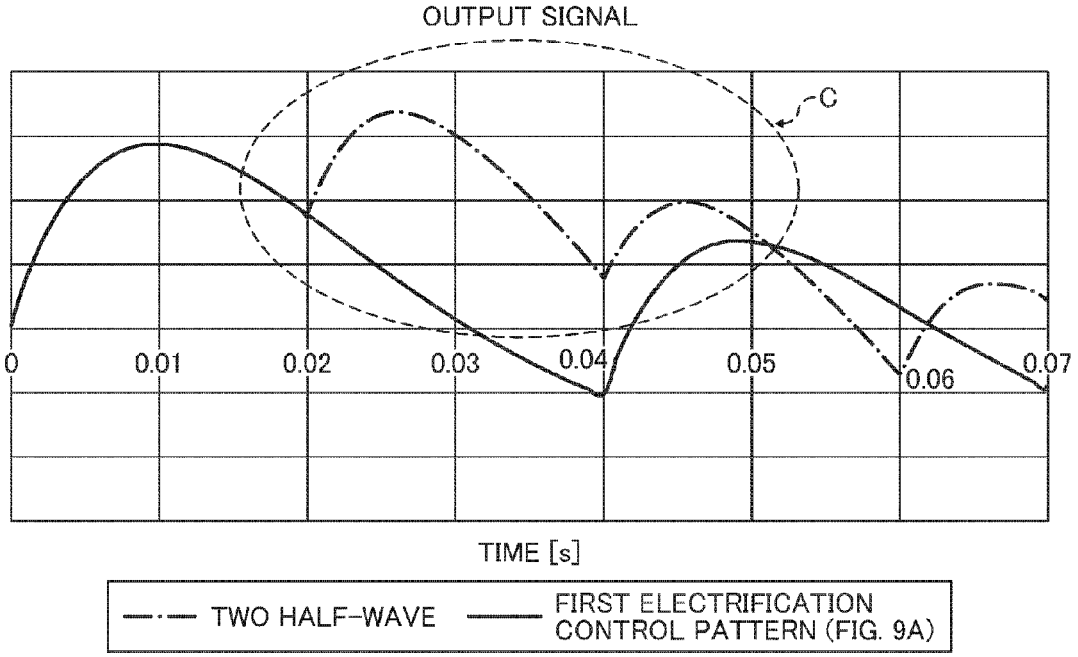
FIG. 12A is a diagram illustrating an example of a simulation result with flicker sensitivity where the commercial power source is 50 Hz.

FIG. 12A shows flicker sensitivity (illustrated by a solid line in FIG. 12A) at time of power distribution performed in accordance with the first power distribution control pattern of FIG. 9A and flicker sensitivity (illustrated by a dot-dash line in FIG. 12A) upon the two half-wave control performed in a case where the commercial power source 80 is at 50 Hz. Both of them are values calculated by use of the filter of FIG. 3B. It is proved that, as illustrated in FIG. 12A, use of the first power distribution control pattern of FIG. 9A can more reduce the flicker sensitivity in the power distribution start period compared to a case of two half-wave control as in a portion surrounded by the dotted line illustrated by C in FIG. 12A.

Figure 12B:
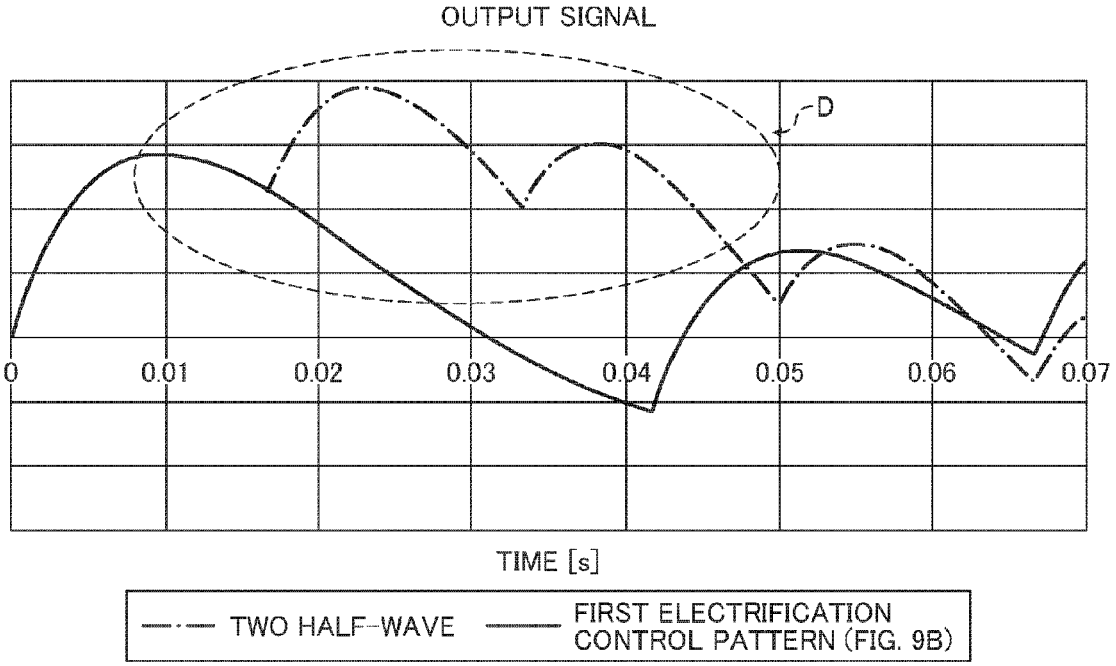
FIG. 12B is a diagram illustrating an example of a simulation result with flicker sensitivity where the commercial power source is 60 Hz.

Moreover, FIG. 12B shows flicker sensitivity (illustrated by a solid line in FIG. 12B) at time of power distribution performed in accordance with the first power distribution control pattern of FIG. 9B and flicker sensitivity (illustrated by a dot-dash line in FIG. 12B) upon the two half-wave control performed in a case where the commercial power source 80 is at 60 Hz. They are also values calculated by use of the filter of FIG. 3B. It is proved that use of the first power distribution control pattern of FIG. 9B can more reduce the flicker sensitivity in the power distribution start period, compared to the case of two half-wave control as in a portion surrounded by the dotted line illustrated by D in FIG. 12B.

Note that 50 Hz or 60 Hz is used for the frequency of the commercial power source 80 in Japan and this frequency varies depending on regions. Thus, as described above, two cases where the frequency is 50 Hz and where the frequency is 60 Hz are prepared for the first power distribution control pattern.

Figure 13:
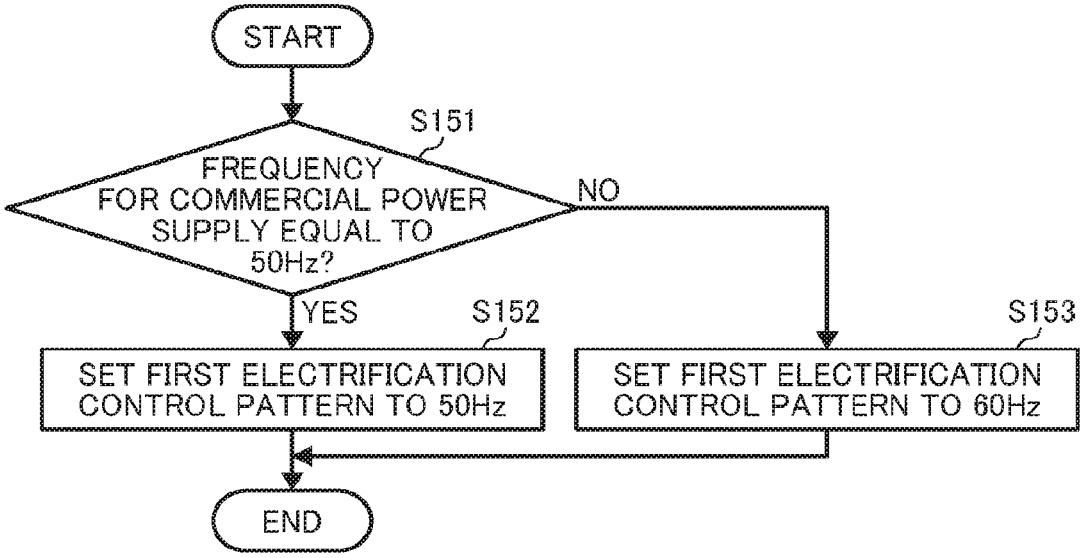
FIG. 13 is a flowchart illustrating operation of selecting the first power distribution control pattern in accordance with the frequency of the commercial power source.

Then for example, the CPU 201 executes processing of steps S151 through S153 illustrated in a flowchart of FIG. 13 at time of, for example, power supply whereby the pattern corresponding to the frequency of the commercial power source 80 can be selected as the first power distribution control pattern.

First, the CPU 201 determines whether or not the frequency of the commercial power source is 50 Hz (S151). If the frequency of the commercial power source is 50 Hz (Y), the processing proceeds to S152, where the first power distribution control pattern is set as a pattern for 50 Hz. If the frequency of the commercial power source is not 50 Hz (N), the processing proceeds to S153, where the first power distribution control pattern is set as a pattern for 60 Hz.

If flicker standards can be satisfied, the first power distribution control pattern may be the same pattern regardless of the frequency of the commercial power source 80.

Here, the second power distribution control pattern used for the power distribution in the second time period TP2 is for the two half-wave control.

This is because, as can be seen from the simulation results of FIG. 4, the waveforms of the two half-wave control, the three half-wave control, and the four half-wave control in the second time period TP2 are in almost the same forms except for a point that their sizes and temperature increase time differ from one another.

Therefore, upon selection of the power distribution control pattern in this time period, for the purpose of suppressing the flicker, a focus may be put on the one which has a small absolute value of the output signal and also the shortest temperature increase time. Then it is desirable that, for the two half-wave control corresponding to this condition, the second power distribution control pattern be provided.

Finally, for the third power distribution control pattern in the third time period TP3, it can be determined based on the same simulation as that of the first power distribution control pattern. Note that, however, for the third power distribution control pattern, the half-wave control pattern (including a combination of a plurality of half-wave controls) with which the flicker sensitivity becomes small when used after the two half-wave control (refer to FIG. 14A for the waveform) adopted as the second power distribution control pattern is searched.

Figure 14A:
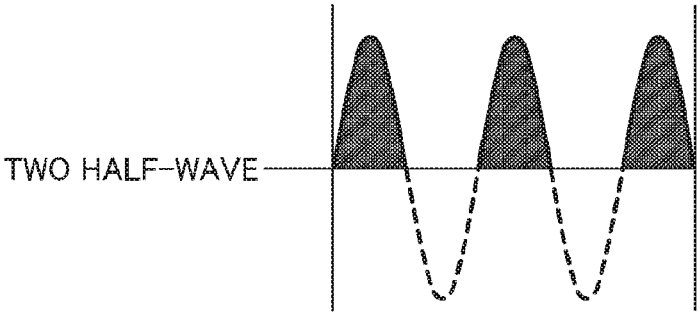
FIG. 14A is a diagram illustrating a waveform of the two-half-wave control.
Figure 14B:
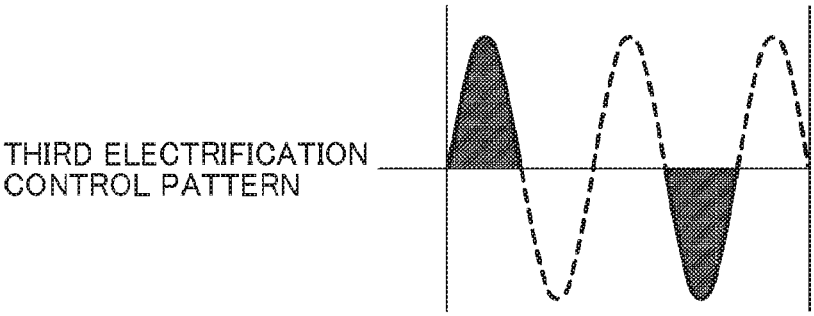
FIG. 14B is a diagram illustrating a waveform of the third power distribution control pattern.

As a result, it has been found out that using, as the third power distribution control pattern, as illustrated in FIG. 14B, the power distribution control pattern with which the two half-wave control is carried out after the three half-wave control is carried out can reduce the flicker sensitivity in the power distribution end period.

Figure 15:
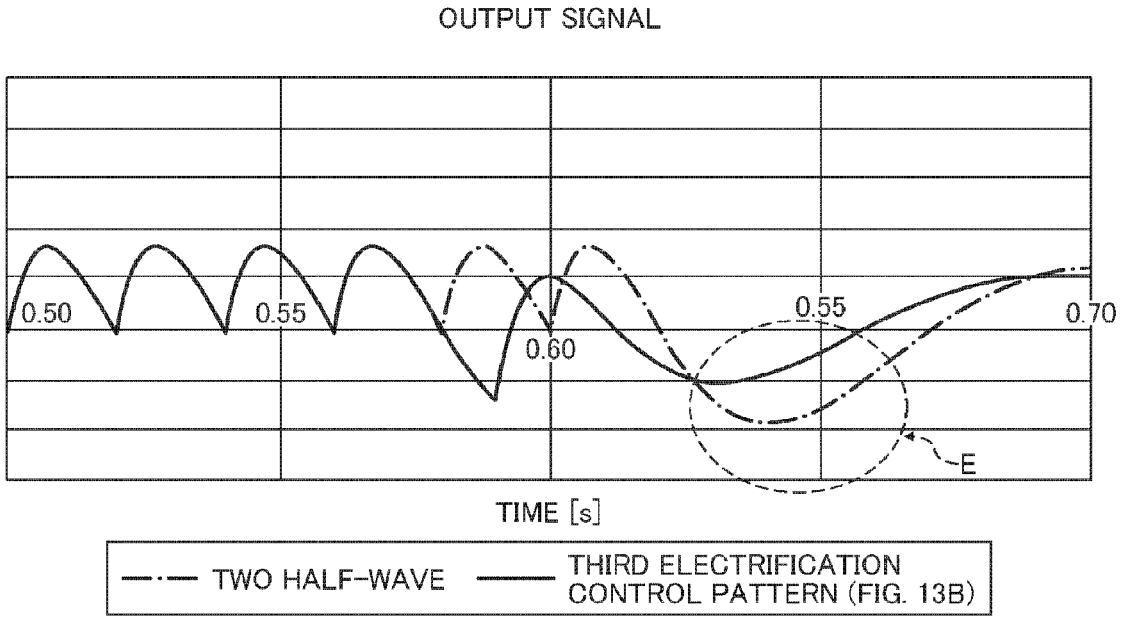
FIG. 15 is a diagram illustrating comparison between respective output signals of the two-half-wave control and the third power distribution control pattern.

FIG. 15 shows, in a case where the commercial power source is at 50 Hz, the flicker sensitivity (a dot-dash line in FIG. 15) when the two half-wave control is performed to achieve the power distribution until the end, and flicker sensitivity (solid line in FIG. 15) when power distribution using the third power distribution control pattern illustrated in FIG. 14B is performed finally. Making comparison between them proves that, as in a portion surrounded by the dotted line illustrated by E in FIG. 15), the flicker sensitivity in the power distribution end period can be more reduced in the case where the third power distribution control pattern is used than in the case where only the two half-wave control is used.

Second Embodiment: FIGS. 16 Through 20

Next, the second embodiment of the invention will be described.

An image forming apparatus A according to the second embodiment includes a halogen heater 60 composed of a plurality of heat-generating elements, and performs a power distribution control on the plurality of heat-generating elements based on power distribution rules to be described later on. Except for this point, it is the same as the image forming apparatus A according to the first embodiment, and thus only those related to the point described above will be described. Moreover, portions in common with or corresponding to the first embodiment will be marked with the same numerals as those of the first embodiment. This point is similarly applicable to embodiments described thereafter.

Figure 16:
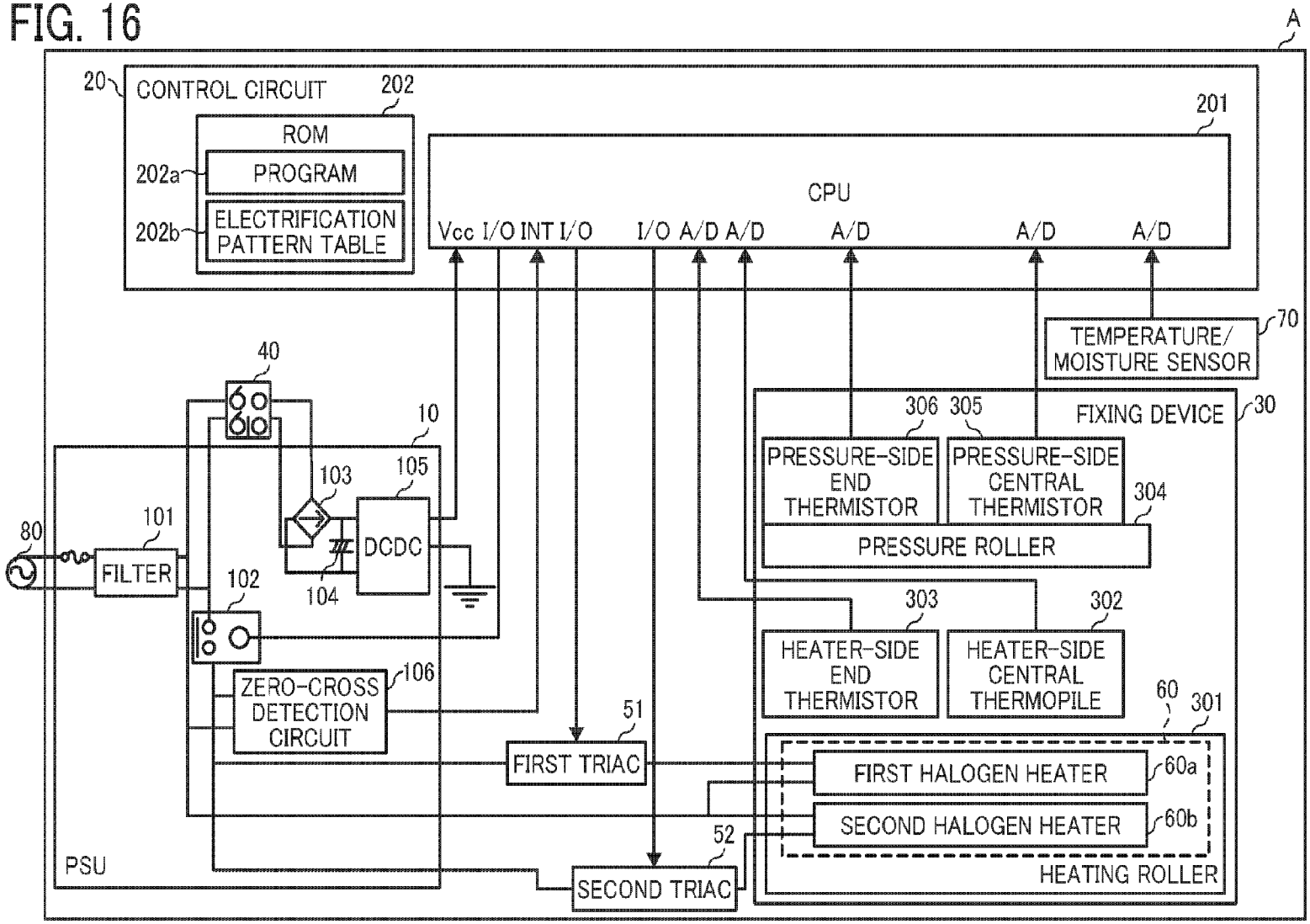
FIG. 16 is a hardware configuration diagram of an image forming apparatus according to a second embodiment of the present invention.

First, FIG. 16 shows hardware configuration of the image forming apparatus A according to the second embodiment of the invention.

The hardware configuration of the image forming apparatus A according to the second embodiment is basically common with that of the first embodiment. The image forming apparatus A of this embodiment is different from the image forming apparatus A according to the first embodiment in a point that the image forming apparatus A according to the second embodiment includes, in the halogen heater 60, a first halogen heater 60*a* and a second halogen heater 60*b* as the heat generating elements. Then to these first and second halogen heaters 60*a* and 60*b*, a first triac 51 and a second triac 52 are connected respectively. The first triac 51 controls on and off of power distribution to the first halogen heater 60*a* and the second triac 52 controls on and off of power distribution to the second halogen heater 60*b*. This permits the first and second halogen heaters 60*a* and 60*b* to independently control the on and off of power distribution.

Also in the second embodiment, the first halogen heater 60*a* and the second halogen heater 60*b* have the same characteristics and have no performance difference therebetween.

Figure 17A:
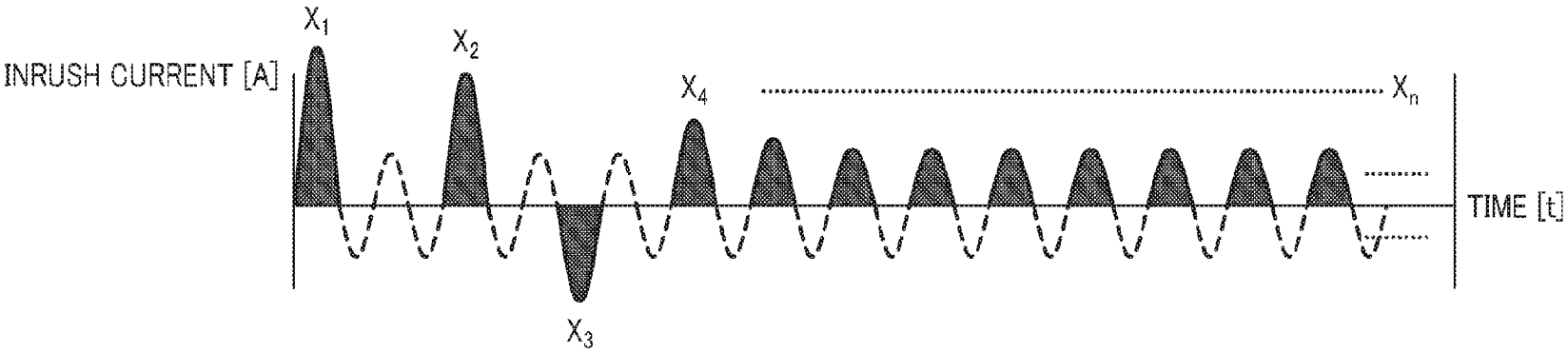
FIG. 17A is a diagram illustrating transition of incoming current upon power distribution to one of two halogen heaters of the image forming apparatus.
Figure 17B:
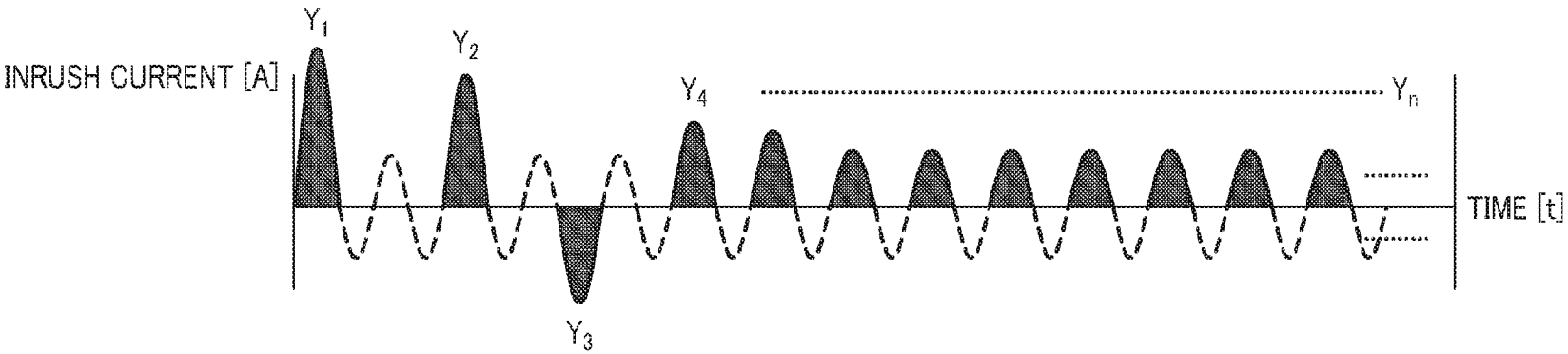
FIG. 17B is a diagram illustrating transition of the incoming current upon power distribution to the one of the two halogen heaters of the image forming apparatus.
Figure 17C:
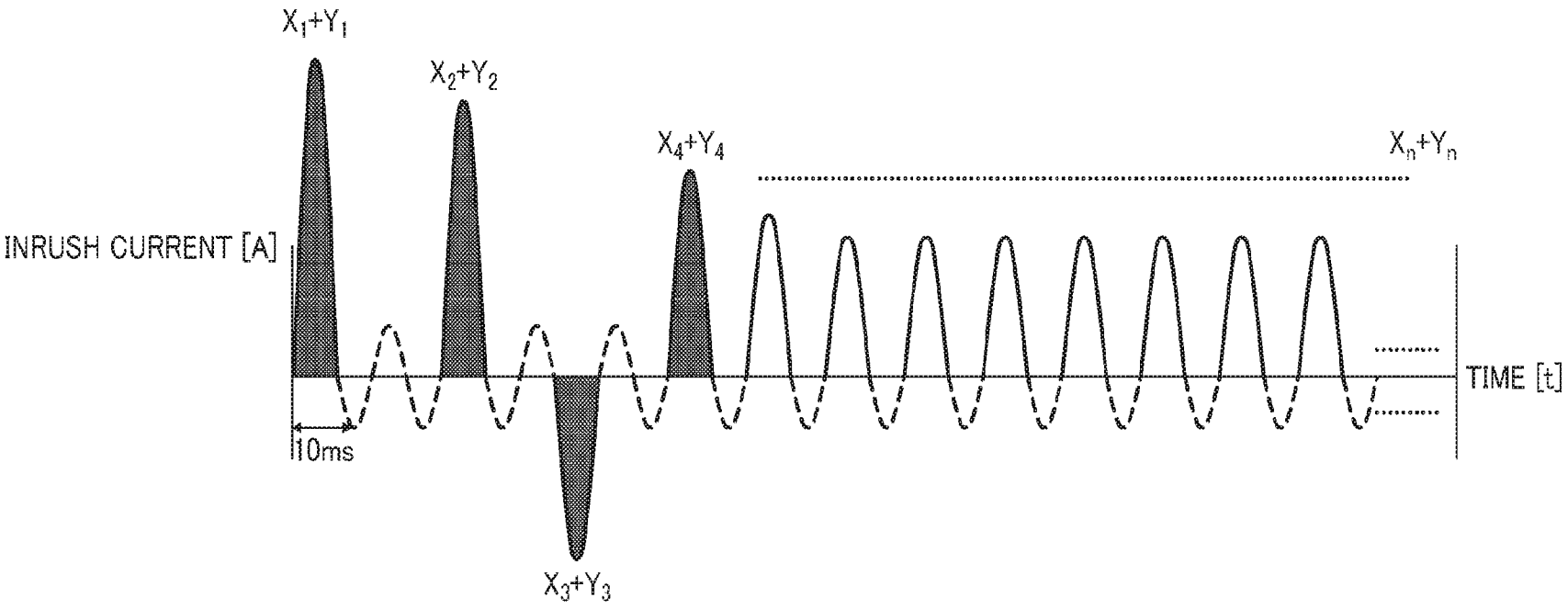
FIG. 17C is a diagram illustrating transition of the incoming current upon power distribution to the two halogen heaters of the image forming apparatus at the same power distribution timing.

Next, FIGS. 17A through 17C show a waveform of an incoming current upon the power distribution (AC power supply) to the first halogen heater 60*a*, a waveform of an incoming current upon the power distribution to the second halogen heater 60*b*, and, as a comparative example, a waveform of an incoming current upon simultaneous power distribution to the first and second halogen heaters 60*a* and 60*b* at each power distribution timing in all power distribution time periods.

(One) power distribution timing refers to a power distribution time period corresponding to one half-wave upon a half-wave control. Moreover, a power distribution start time point in each power distribution timing is referred to as a power distribution start timing.

In graphs of FIGS. 17A through 17C, the incoming currents [A] are plotted at vertical axes and times [t] are plotted at horizontal axes. Moreover, where a half cycle is 10 ms (commercial power source at 50 Hz), the incoming currents upon the power distribution performed at power distribution timings determined by the half-wave control in accordance with first to third power distribution control patterns are indicated by regions all painted in black, as is the case with the first embodiment. A broken-lined sections indicate time periods in which power distribution is actually not performed.

$X_n$ in FIGS. 17A through 17C denotes an n-th power distribution timing at which the power distribution to the first halogen heater 60*a* is performed. $Y_n$ denotes an n-th power distribution timing at which the power distribution to the second halogen heater 60*b* is performed. $X_m+Y_n$ denotes a power distribution timing upon the simultaneous power distribution to the first and second halogen heaters 60*a* and 60*b*, and this timing is defined as an m-th power distribution timing at which the power distribution to the first halogen heater 60*a* is performed and also as an n-th power distribution timing at which the power distribution to the second halogen heater 60*b* is performed.

As illustrated in FIGS. 17A and 17B, upon the power distribution to only one of the first and second halogen heaters 60*a* and 60*b*, a large incoming current is generated at the earlier power distribution timings, but as is the case with the first embodiment, controlling the timings of the power distribution by use of the first to third power distribution control patterns can reduce the flicker.

However, as illustrated in FIG. 17C, as a result of the simultaneous power distribution to the first and second halogen heaters 60*a* and 60*b* at the same timing, a value of the incoming current of a power distribution section $X_n+Y_n$ is obtained by adding together a value of the incoming current at a power distribution section $X_n$ of the first halogen heater 60*a* and a value of the incoming current at a power distribution section $Y_n$ of the second halogen heater 60*b*.

Thus, even if the power distribution control is performed in the same manner as in cases of FIGS. 17A and 17B, the incoming current increases by an amount corresponding to an increase in a number of heaters. Thus, the flicker also increases accordingly.

Figure 18:
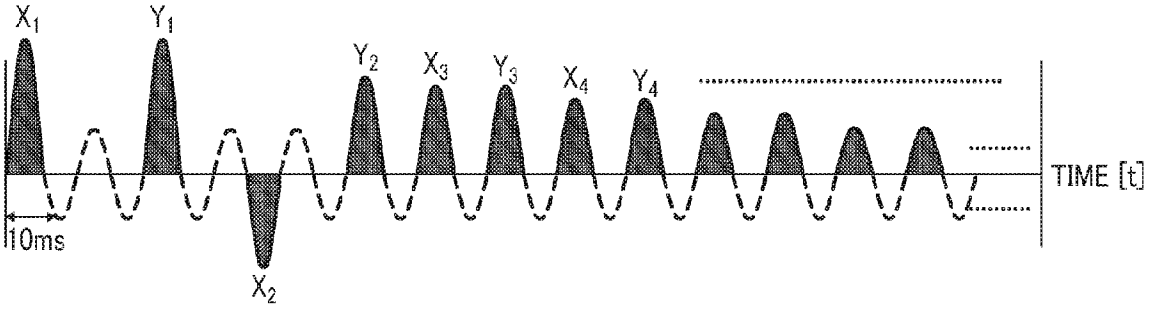
FIG. 18 is a diagram illustrating one example of power distribution control on a first halogen heater and a second halogen heater and transition of an incoming current for the entire halogen heater upon power distribution control of these halogen heaters in the image forming apparatus according to the second embodiment.

Next, FIG. 18 shows one example of a power distribution control of the first halogen heater 60*a* and the second halogen heater 60*b* in the image forming apparatus A according to the second embodiment, and transition of an incoming current for the entire halogen heater 60 upon this power distribution control.

A power distribution control table illustrated at a bottom of FIG. 18 shows whether or not to perform power distribution to the first halogen heater 60*a* and the second halogen heater 60*b* respectively in an n-th half-wave time period since power distribution start. "0" denotes no power distribution, and "1" denotes power distribution. A first heater and a second heater are the first halogen heater 60*a* and the second halogen heater 60*b*, respectively.

In the example of FIG. 18, portions all painted in black in a graph is power distribution timings. These power distribution timings are determined by the half-wave controls in accordance with the first to third power distribution control patterns, as is the case with the first embodiment. Then at each determined power distribution timing, power distribution to the first halogen heater 60*a* and the power distribution to the second halogen heater 60*b* are performed alternately. That is, at the first power distribution timing (n=1), the first power distribution to the first halogen heater 60*a* is performed ($X_1$), at the second power distribution timing (n=5), the first power distribution to the second halogen heater 60*b* is performed ($Y_1$), and at the third power distribution timing (n=8), the second power distribution to the first halogen heater 60*a* is performed ($X_2$) . . . . Here, n=1, 5, 8, . . . are the power distribution timings, but which section becomes a power distribution timing varies depending on the power distribution control pattern used.

This reduces the incoming current in view of the entire halogen heater 60 at a value as low as that upon the power distribution to only one halogen heater, which can therefore reduce the flicker, as is the case with the first embodiment. This effect can be obtained since the number of halogen heaters to which the simultaneous power distribution is performed is smaller than that in a case of the comparative example illustrated in FIG. 17C.

However, performing the control illustrated in FIG. 18 results in a smaller amount of heat given to the heating roller 301 per unit time by the halogen heater 60 than that in the case of comparative example illustrated in FIG. 17C, which possibly increase time required for heating the heating roller 301 up to a target temperature.

Figure 19:
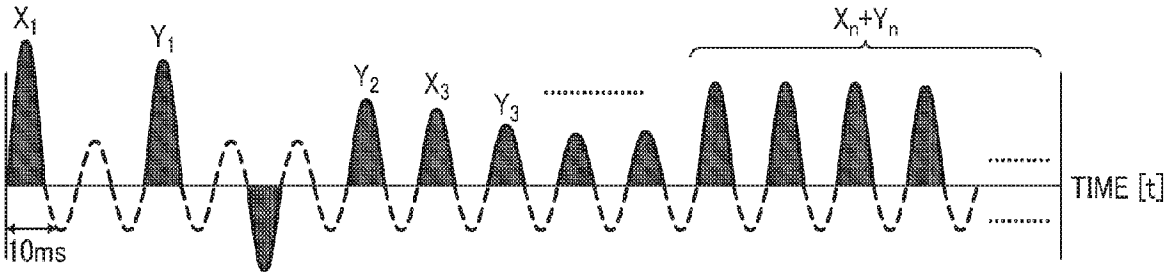
FIG. 19 is a diagram illustrating an example of power distribution control different from that of FIG. 18 in the image forming apparatus according to the second embodiment.

Thus, FIG. 19 shows another example of power distribution control in the image forming apparatus A according to the second embodiment. A form of FIG. 19 is common with FIG. 18.

The example illustrated in FIG. 19 differs from the example of FIG. 18 in a point that power distribution to both the first halogen heater 60*a* and the second halogen heater 60*b* is performed at each power distribution timing after passage of a predetermined period since power distribution start (at and after n=21 in the example of FIG. 19).

As can be seen from FIGS. 18 and 19, immediately after the power distribution start, the incoming currents are large but as the number of times of power distribution (in units of half wave) increases, the incoming currents gradually decreases. Therefore, it can be assumed that after passage of some time period, even upon generation of a total incoming current of the first halogen heater 60*a* and the second halogen heater 60*b* as at the power distribution timing $X_a+Y_a$, not so great flicker does not occur.

Thus, after the passage of the predetermined period since the power distribution start, at each power distribution timing, performing the power distribution to both the first halogen heater 60*a* and the second halogen heater 60*b* can increase the amount of heat given to the heating roller 301 per unit time by the halogen heater 60 and shorten a period required for heating the heating roller 301 up to the target temperature.

For example, in the control of FIG. 18, it takes n=120, that is, 1200 ms to achieve the heating to the target temperature, but in the control of FIG. 19, it takes only n=80, that is, 800 ms.

Which of the control of FIG. 18 and the control of FIG. 19 is to be applied may be fixed or may be selected manually by the user or automatically in accordance with some condition. In any case, to perform the control of FIG. 18, power distribution order rules such as "power distribution to the first halogen heater 60*a* and power distribution to the second halogen heater 60*b* are performed alternately at each power distribution timing" are previously stored in the image forming apparatus A. To perform the control of FIG. 19, power distribution order rules such as "power distribution to the first halogen heater 60*a* and power distribution to the second halogen heater 60*b* are performed alternately at each power distribution timing in the predetermined time period since the power distribution start and then at each power distribution timing thereafter, power distribution to both the first halogen heater 60*a* and the second halogen heater 60*b* is performed" are previously stored in the image forming apparatus A. From which halogen heater the "alternate" power distribution start may be at random, previously defined, or determined in accordance with some criteria.

Figure 20:
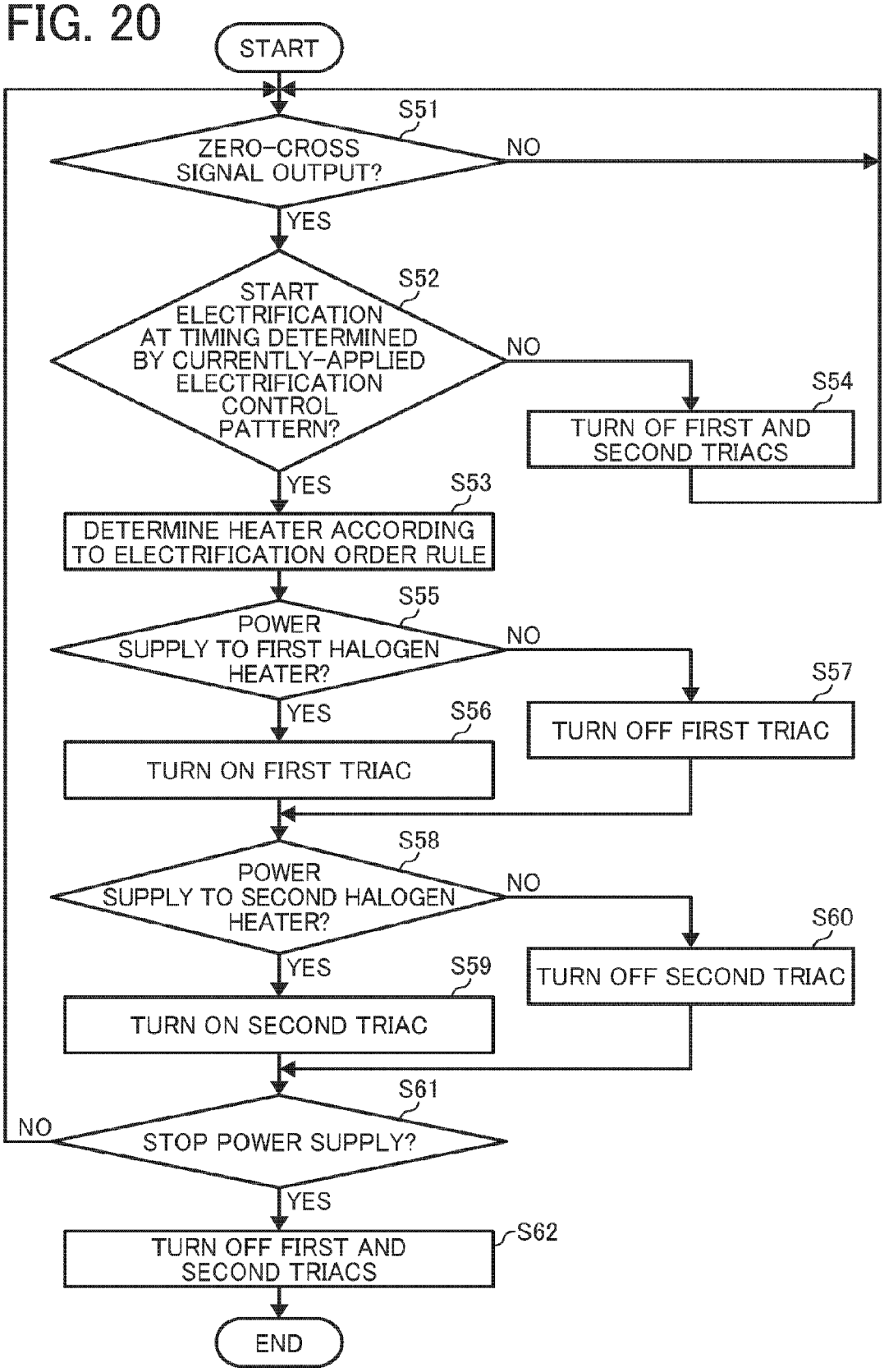
FIG. 20 is a flowchart of power distribution processing performed by the image forming apparatus of FIG. 16.

Next, FIG. 20 shows processing of the power distribution control in accordance with the power distribution order rules described above. This processing is performed by executing a desired program by a CPU 201.

Also in the second embodiment, as is the case with the first embodiment, the CPU 201 executes the processing of FIG. 5, and the processing of FIG. 20 is provided for switching on and off of the power distribution to each halogen heater at each power distribution timing (half-wave time period for which power distribution is performed under a half-wave control) defined in accordance with the first to third power distribution control patterns in the processing of FIG. 5.

In step S11 of FIG. 5, the CPU 201, with reference to the current temperature of the heating roller 301 detected by the heater-side central thermopile 302 every control cycle of 600 ms, starts the processing of FIG. 20 simultaneously with proceeding to the processing at and after step S12 upon fall of this temperature below T1 degrees Celsius.

In the processing of FIG. 20, the CPU 201 first waits until a zero-cross signal is outputted from a zero-cross detection circuit 106, that is, until a timing at which the next half-wave of a voltage of an AC commercial power source 80 starts (S51).

Then if Yes in step S51, the CPU 201 determines whether or not it is the power distribution start timing with the power distribution control pattern currently applied, from among the power distribution control patterns of FIG. 5 (S52).

If it is not the power distribution starting timing (No in S52), the CPU 201 turns off the first and second triacs 51 and 52 (S54) to stop the power distribution to the first halogen heater 60*a* and the second halogen heater 60*b*, and returns to step S51. For any triac which is off from a period before the processing of step S54, an off-state may be maintained. This point also applies to on and off processing of the triacs thereafter.

On the other hand, if it is the power distribution starting timing in step S52 (Yes in S52), the CPU 201, with reference to the power distribution order rules described above (S53), determines whether to perform power distribution to one or both of the first halogen heater 60*a* and the second halogen heater 60*b* at the power distribution start timing which starts from this power distribution start timing. For example, if the power distribution order rule "the power distribution to the first halogen heater 60*a* and the power distribution to the second halogen heater 60*b* are alternately performed at each power distribution timing" has been set and the power distribution to the first halogen heater 60*a* has been performed at the previous power distribution timing, the power distribution to the second halogen heater 60*b* is performed at this power distribution timing.

Next, the CPU 201 switches on and off of the first triac 51 and the second triac 52 based on whether the power distribution to one or both of the first halogen heater 60*a* and the second halogen heater 60*b* is to be performed in accordance with determination in step S53 (S55 through S60).

Next, the CPU 201 determines whether or not an instruction for stopping the power distribution has been provided in step S17 of FIG. 5 (S61), if Yes, turns off the first an second triacs 51 and 52 (S62), and ends this processing. On the other hand, if No, the CPU 201 returns to step S51 and repeats the processing.

Specifically, the processing of FIG. 20 performs power distribution sequentially with the first to third power distribution control patterns in accordance with the processing of FIG. 5, and ends upon reach of a surface temperature of the heating roller 301 detected by the heater-side central thermopile 302 at the target temperature T3 degrees Celsius.

The description on the power distribution control processing using the two halogen heaters according to the second embodiment ends, and as described above, not providing the same power distribution timing for sections where power distribution to the first halogen heater 60*a* and power distribution to the second halogen heater 60*b* are performed based on the power distribution order rules can reduce the incoming current and reduce the flicker. Moreover, within a predetermined time period since the power distribution start at which the incoming current becomes large, the power distribution to the first halogen heater 60*a* and the power distribution to the second halogen heater 60*b* are not performed simultaneously at the same power distribution timing, and then the power distribution to the first halogen heater 60*a* and the power distribution to the second halogen heater 60*b* are performed simultaneously at the same power distribution timing, thereby making it possible to reduce the flicker while shortening a period required for increasing the temperature of the heating roller 301 up to a predetermined temperature.

The power distribution order rules adopted in the processing of FIG. 20 are more typically rules defining, for example, order of power distribution to each halogen heater and whether or not to perform simultaneous power distribution to a plurality of heaters can be performed at each power distribution timing with the first to third power distribution control patterns in a case where a plurality of halogen heaters are provided as electricity generating elements.

Here, an example where the two heaters are provided has been described, but even in a case where three or more heaters (defined as an M-number) are used, power distribution order rules for reducing the flicker can be created based on the same idea as described above. Specifically, at the power distribution timing in a first predetermined time period since the power distribution start, AC power may be supplied to only part of a plurality of heat generating elements. Also upon power distribution to an (M−1)-number of heaters included in the M-number of heaters, this also corresponds to "only part of", and thus the flicker can be more reduced than upon simultaneous power distribution to all the heat generating elements.

Moreover, at the given power distribution timing after the predetermined time period, even upon the power distribution to all the heat generating elements, an influence on the flicker is small, which can therefore provide effect of shortening of the period required for a temperature increase on one hand.

At the power distribution timing in the first predetermined time period, sequential power distribution to the heat-generating elements at the respective power distribution timings may be performed. This is because this permits uniform heat generation at each heat generating element while reducing the flicker. The "sequential" means "in a manner such as to cyclically vary a power distribution target.

Figure 21:
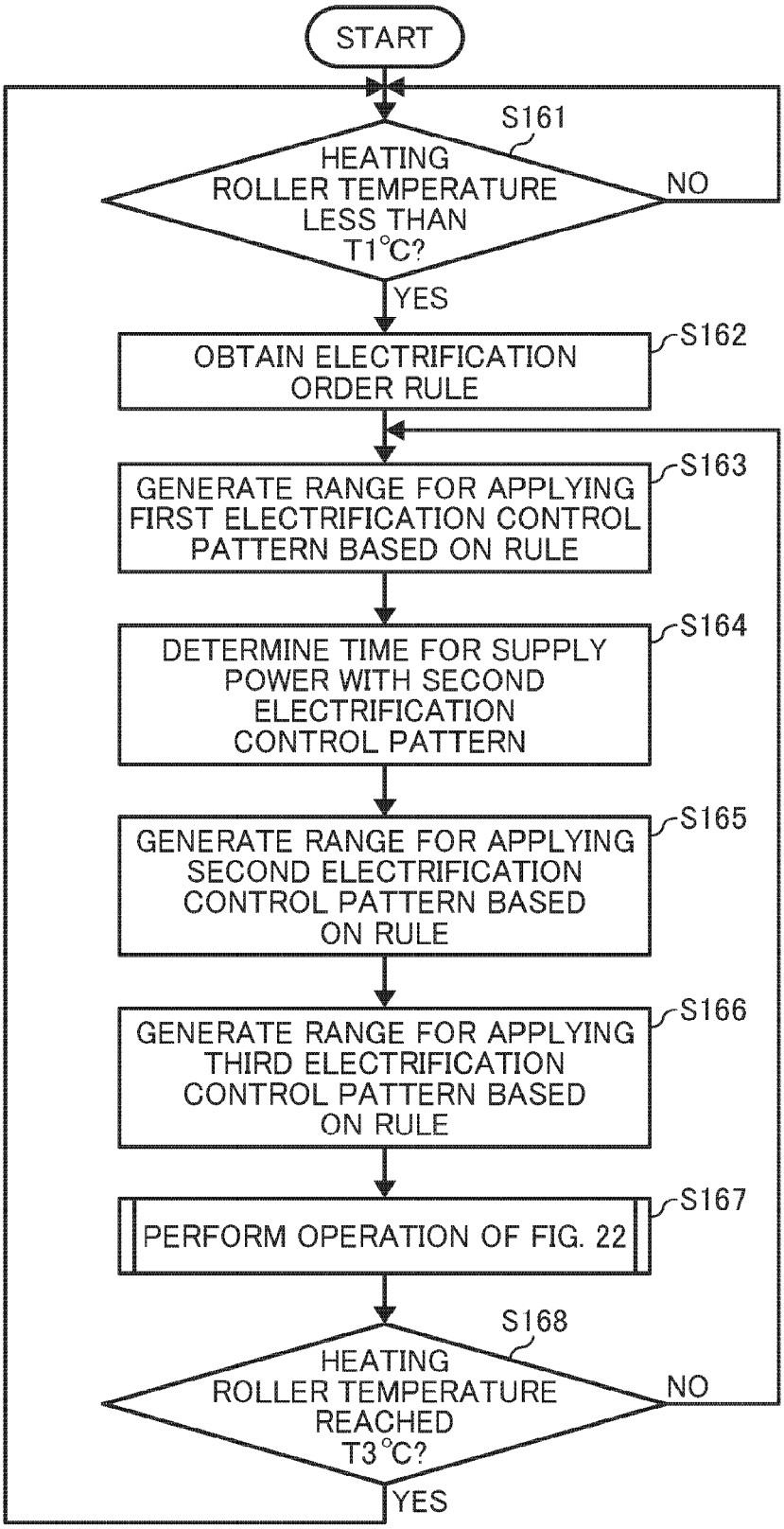
FIG. 21 is a flowchart illustrating operation of creating a power distribution control table executed by an image forming apparatus according to a third embodiment.
Figure 22:
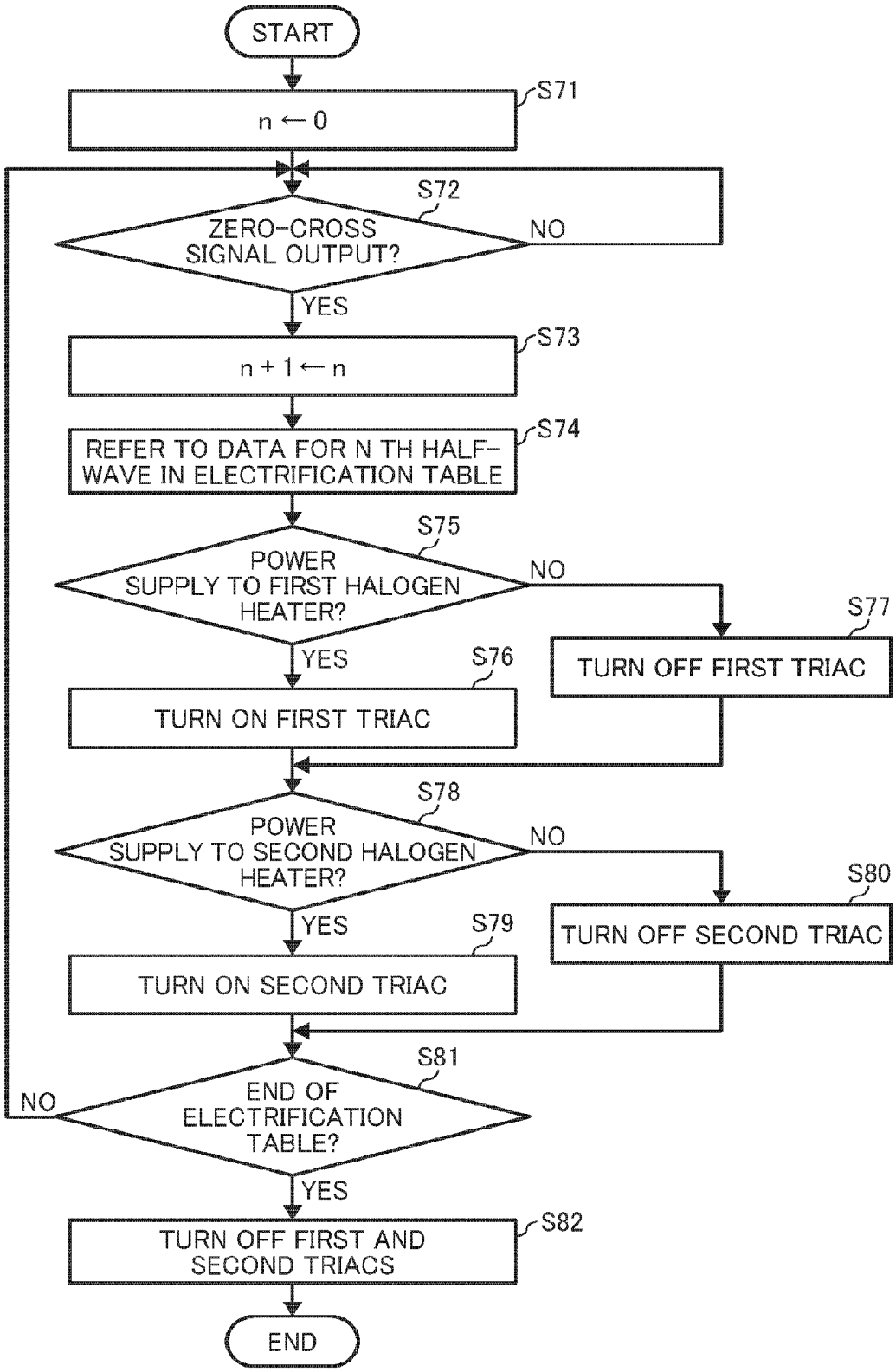
FIG. 22 is a flowchart illustrating power distribution control processing based on the power distribution control table executed by the image forming apparatus according to the third embodiment.

Third Embodiment: FIGS. 21 and 22

Next, the third embodiment of the invention will be described.

An image forming apparatus A according to the third embodiment differs from that of the second embodiment in a point that a power distribution control table is created and power distribution to a plurality of heat generating elements is performed based on this table. The third embodiment is the same as the second embodiment in other points, and thus only those related to this point will be described. The power distribution control table refers to, as illustrated at bottoms of FIGS. 18 and 19, a table defining whether or not to perform power distribution to each of the heat generating elements (a first halogen heater 60*a* and a second halogen heater 60*b*) in an n-th half-wave time period in units of half-wave since start of power distribution to a halogen heater 60.

FIG. 21 shows a flowchart of processing of creation of the power distribution control table executed by a CPU in the image forming apparatus A according to the third embodiment. This processing corresponds to the processing of FIG. 6 in the first embodiment and its start condition is the same as that in FIG. 6.

In the processing of FIG. 21, the CPU 201 first waits until a temperature of a heating roller 301 reaches T1 degrees Celsius or more (S161). The temperature of the heating roller 301 is, as described in the second embodiment, a current temperature detected by a heater-side central thermopile 302.

If Yes in step S161, the CPU 201 acquires power distribution order rules also described in the second embodiment (S162) so that they can be referred to in the following processing.

Next, the CPU 201, based on the power distribution order rules acquired in step S162, creates a portion of a time period of the power distribution control table to which portion a first power distribution control pattern is applied (S163). Specifically, this determines the half-wave time period at which place in accordance with the first power distribution control pattern, and thus power distribution control table is created so that power distribution to the heat generating element defined in accordance with the power distribution order rules can be performed at its power distribution timing. Until which time period the control in accordance with the first power distribution control pattern will be performed may be determined in the same manner as in the first embodiment.

Next, the CPU 201 determines a period for which power distribution with a second power distribution control pattern is performed (S164), and based on the power distribution control rules acquired in step S162, creates a portion of the time period to which the second power distribution control pattern is applied (S165). A determination method in step S64 is the same as that in step S23 of FIG. 6, and a creation method in step S165 is the same as that in step S163 except for a point in that the power distribution control pattern used differs.

Next, the CPU 201, based on the power distribution control rules acquired in step S162, creates a portion of the time period of the power distribution control table to which portion the third power distribution control pattern is applied (S166). A length of the time period for which the power distribution is performed with the third power distribution control pattern is the same as those in FIGS. 5 and 6, and a creation method in step S166 is the same as that in step S163 except for a point that the power distribution control pattern used differs.

Upon completion of the processing up to this point, the power distribution control table is completed, and thus the CPU 201 executes the processing of FIG. 22 (S167). Upon ending of the processing of FIG. 22, the CPU 201 determines whether or not the current temperature of the heating roller 301 has reached T3 degrees Celsius (S168), and if it has not yet reached (No in S168), the CPU 201 returns to step S163 and repeats the processing. This is processing corresponding to a case where No is applicable in step S26 of FIG. 6. On the other hand, if Yes in S168, the CPU 201 returns to step S61. This is processing corresponding to a case where Yes is applicable in step S26 of FIG. 6. The processing corresponding to step S27 of FIG. 6 is included in the processing of FIG. 22, and is not included in the processing of FIG. 21.

Next, FIG. 22 shows a flowchart of power distribution control processing using the power distribution control table described above.

The processing of FIG. 22 is executed in step S67 of FIG. 21 as described above, and in this processing, the CPU 201 first resets a counter n at 0 (S71). Then in the same manner as that in step S51 of FIG. 20, the CPU 201 waits until a zero-cross signal is outputted from a zero-cross detection circuit 106 (S72).

When Yes in step S72, the CPU increments the n (S73), and refers to data in the n-th half-wave time period of the power distribution control table created in the processing of FIG. 21 (S74). Then based on this data, the CPU 201 switches on and off of a first triac 51 and a second triac 52 (S75 through S80), thereby controlling on and off of the power distribution to the first halogen heater 60*a* and the second halogen heater 60*b*.

Upon ending of processing in step S79 or S80, the CPU 201 determines whether or not the processing until an end of the power distribution control table has ended (S81). If Yes here, the CPU 201 turns off the first and second triacs and ends this processing.

On the other hand, if No, the CPU 201 returns to step S72 and repeats this processing until Yes becomes applicable in step S81.

The third embodiment described above can also provide the same effects as that in the second embodiment. Note that in the processing of FIG. 21, the power distribution control table until ending of heating is first created, but it is also possible to add, as appropriate, data to the power distribution control table based on, for example, the temperature of the heating roller 301 in accordance with proceedings of the power distribution.

Figure 23:
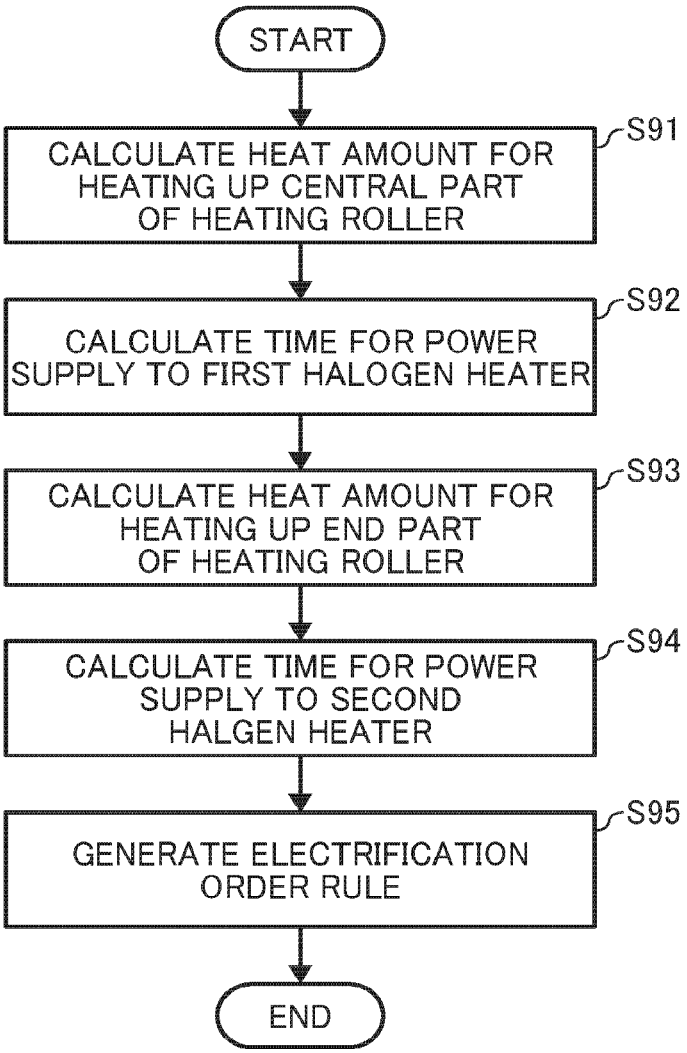
FIG. 23 is a flowchart illustrating processing of power distribution order determination executed by an image forming apparatus according to a fourth embodiment.
Figure 24:
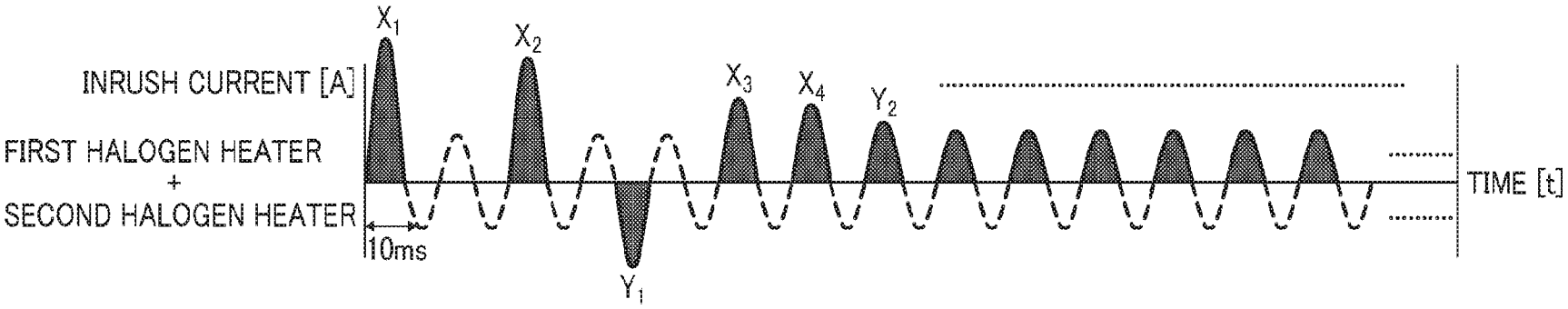
FIG. 24 is a diagram corresponding to FIG. 18 illustrating a power distribution control table generated in the processing of FIG. 23 and transition of an incoming current upon power distribution control performed by use of this table.

Fourth Embodiment: FIGS. 23 and 24

Next, the fourth embodiment of the invention will be described.

An image forming apparatus A according to the fourth embodiment differs from that according to the third embodiment in a point that, in accordance with an amount of heat required for heating each heat generating element for increasing a temperature of a heating roller 301 up to a target temperature, a number of times of power distribution to each heat generating element is varied. It is the same as the third embodiment in other points, and thus only those related to this point will be described.

First, the image forming apparatus A according to the fourth embodiment has basic configuration in common with that according to the third embodiment, but different heat generating elements mainly give heat to different portions, i.e., a first halogen heater 60*a* heats a central part of the heating roller 301 and a second halogen heater 60*b* heats an end part thereof. Moreover, a surface temperature of the central part of this heating roller 301 is detected by a heater-side central thermopile 302 and a surface temperature of the end part thereof is detected by a heater-side end thermistor 303.

When the image forming apparatus A performs image formation, of the surface of the heating roller 301, at a portion near a center with which a recording medium makes contact and through which it passes at time of the image formation, heat is taken from the surface and its temperature more greatly decreases than that near the end part. Thus, it can be assumed that the surface temperature at the portion near the center after the image formation becomes lower than the surface temperature of the end part. Needless to say, it is also possible that a temperature difference arises due to a different cause.

Therefore, in attempts to heat the entire heating roller 301 up to a uniform target temperature T3 degrees Celsius, an amount of heat to be given may differ between the portion near the center and the end part.

Thus, in the fourth embodiment, to heat the portion near the center and the end part of the heating roller 301, in accordance with the respective amounts of heat required, a number of power distribution timings at which power distribution to the first halogen heater 60*a* and the second halogen heater 60*b* is performed is varied. This can provide the same target temperature at the same timing for the portion near the center and the end part even in a case where the amount of heat to be given differs between the portion near the center and the end part. That is, the entire heating roller 301 can be heated at a uniform temperature without waiting for ending of one heating after ending of another heating.

FIG. 23 shows a flowchart of processing of determination of power distribution order rules in accordance with the required amounts of heat executed by the CPU 201.

If Yes in step S61 of FIG. 21, the CPU 201 executes the processing of FIG. 23 before step S62. In the processing of FIG. 23, based on a difference between a current temperature of the central part of the heating roller 301 as a detection temperature detected by the heater-side central thermopile 302 and the target temperature of the heating roller 301, the CPU 201 first calculates an amount of heat required for increasing the temperature of the central part of the heating roller 301 up to the target temperature (S91).

Here, it is possible that the required amount Q1 is approximately calculated by Q1=c1×ΔT1 where a difference from the target temperature is ΔT1 and heat capacity of the central part of the heating roller 301 is c1. Needless to say, loss due to, for example, heat radiation at time of heat transfer, an error due to, for example an environment temperature at time of temperature detection, etc. may be considered.

Next, using the amount of heat obtained in step S91, a period of power distribution to the first halogen heater 60*a* is calculated (S92). Here, the obtained period of power distribution means a total period required for power distribution from a start to an end of heating. Dividing the period of power distribution with a period per one power distribution timing can obtain a number of power distribution timings at which power distribution needs to be performed.

Then the period t1 of power distribution can be approximately calculated by t1=Q1/q1 where an amount of heat that can be given by the first halogen heater 60*a* to the central part of the heating roller 301 per unit time of power distribution is q1. Assumed here is that the first halogen heater 60*a* provides heat only to the central part of the heating roller 301, but if this assumption is not adequate, the calculation formula may be changed, additionally taking heating of the end part into consideration.

Next, based on a difference between the temperature detected by the heater-side end thermistor 303 and the target temperature of the heating roller 301, the CPU 201 calculates an amount of heat required for increasing the temperature of the end part of the heating roller 301 up to the target temperature (S93). Then by using the amount of heat obtained in step S93, the CPU 201 calculates a period of power distribution to the second halogen heater 60*b* (S94). The calculation of the amount of heat required and the period of power distribution can be performed in the same manner as in steps S91 and S92.

Specifically, the amount Q2 of heat required can be approximately calculated by Q2=c2×ΔT2 where a difference from the target temperature is ΔT2 and heat capacity of the end part of the heating roller 301 is c2. The duration t2 of power distribution can be approximately calculated by t2=Q2/q2 where an amount of heat that can be given to the end part of the heating roller 301 per unit time of power distribution by the second halogen heater 60*b* is q2.

Next, the CPU 201 calculates a ratio between the respective power distribution periods calculated in steps S92 and S94, and based on this ratio, generates power distribution order rules in a manner such that a ratio between a number of power distribution timings at which the power distribution to the first halogen heater 60*a* is performed and a number of power distribution timings at which the power distribution to the second halogen heater 60*b* is performed becomes close to the aforementioned ratio (S95), and ends the processing of FIG. 23. Then in steps at and after S63 of FIG. 21, a power distribution control table is generated in accordance with the power distribution order rules generated here.

For example, if t1:t2=2:1, it is possible to generate such power distribution order rules "the power distribution to the second halogen heater 60*b* is performed once every time the power distribution to the first halogen heater 60*a* is performed twice". Then a power distribution control in accordance with the power distribution order rules performs power distribution in order of "first", "first", "second", "first", "first", "second" . . . at the power distribution timing defined in accordance with each power distribution control pattern. Moreover, if the ratio between the numbers of times of power distribution to the respective heat generating elements within a unit time becomes close to a value t1:t2, the order is not necessary this order.

FIG. 24 shows an example of the power distribution control table generated in accordance with the power distribution order rules generated based on the processing of FIG. 23 and a transition of an incoming current upon control of power distribution in accordance with this power distribution control table. A form of FIG. 24 is the same as that of FIG. 18.

In the example of FIG. 24, the power distribution control pattern used is the same as that of FIG. 18, and also a point that power distribution to only one of the first and second halogen heaters 60*a* and 60*b* at each power distribution timing is performed is also common between FIG. 24 and FIG. 18, and thus the transition of the incoming current is also the same as that of FIG. 18.

However, it is designed such that the ratio between the number of times of power distribution to the first halogen heater 60*a* and the number of times of power distribution to the second halogen heater 60*b* becomes 2:1. Therefore, more heat can be given to the central part of the heating roller 301 per unit time. Therefore, even upon starting with the temperature of the central part being lower than that of the end part, the temperatures of the central part and the end part can be set at the same target temperature simultaneously.

Shortly speaking, the power distribution control described above defines, based on the amount of heat to be generated at each heat generating element, the number of power distribution timings at which power is supplied to each heat generating element, and determines, in accordance with this number, to which heat generating element AC power is to be supplied. Then this makes it possible to perform heating with a desired amount of heat while suppressing flicker even in a case where the amounts of heat with which the heat generating elements are heated differ from each other.

For the power distribution order rules determined in step S95 of FIG. 23, as the ratio of the number of power distribution timings, several candidate ratios such as 3:1, 5:2, 2:1, 3:2, and 1:1 may be prepared, and for each candidate ratio, order of power distribution to each heat generating element may be previously prepared.

Moreover, it is needless to say that the power distribution order rules generated by the processing of FIG. 23 can be applied to the processing of FIG. 20 of the second embodiment. In this case, after Yes in step S52, the processing of FIG. 23 may be executed before step S53.

The descriptions of the first to fourth embodiments above end, but in the invention, detailed configuration of the apparatus, detailed configuration of the fixing device, detailed configuration of the power distribution control pattern, detailed processing procedures, etc. are not limited to those described in the embodiments.

Moreover, the invention can also be implemented as a heating control device which does not have components, such as the halogen heater 60, targeted for power supply, and can also be implemented as a power distribution control device in which the heater is not targeted for power supply.

The programs related to the control of power distribution to the halogen heater 60 performed by the image forming apparatus A according to the invention may be stored in the ROM 202 or in, for example, an external recording medium. Moreover, it may be provided while stored in a given non-volatile recording medium such as a memory card, a compact disc (CD), a digital versatile disc (DVD), or a blue ray disc. The programs recorded on these recording mediums can be installed in another image forming apparatus to thereby execute each of the procedures described above.

Further, it is also possible to download it from a network-connected external device including a recording medium on which programs are recorded or from an external device with a recording section storing programs to execute it.

Moreover, it is needless to say that the configuration of the embodiments and modified examples described above can be carried out in any combination unless inconsistency arises.

Numerous additional modifications and variations are possible in light of the above teachings. It is therefore to be understood that within the scope of the appended claims, the disclosure of the present invention may be practiced otherwise than as specifically described herein. For example, elements and/or features of different illustrative embodiments may be combined with each other and/or substituted for each other within the scope of this disclosure and appended claims.

What is claimed is:

1. A heating device comprising:

a heater configured to heat a predetermined heating target; and circuitry configured to control supply of AC power to the heater, perform power distribution to the heater in units of AC half wave only, control the power supply to the heater in accordance with power distribution control patterns respectively corresponding to a first time period as a power distribution start period, when the power supply gradually starts supplying power to the heater over a first predetermined period of time, a third time period as a power distribution stop period, when the power supply gradually stops supplying power to the heater over a second predetermined period of time, and a second time period between the first time period and the third time period, when the power supply continuously supplies power to the heater, wherein each of the first time period, the second time period, and the third time period is a time period in which the circuitry supplies AC power to the heater.

2. The heating device according to claim 1, wherein the circuitry is further configured to generate, for each frequency of a commercial power source, at least a power distribution control pattern corresponding to the first time period, and control the power supply to the heater in accordance with the power distribution control pattern according to a frequency of the commercial power source as a power supply source during the first time period.

3. The heating device according to claim 1, wherein the circuitry is further configured to change a period of power distribution during the second time period in accordance with an amount of heat to be given to the heating target.

4. The heating device according to claim 3, wherein the circuitry is further configured to estimate a degree of time degradation of the heater, and increase the period of power distribution during the second time period according to the estimated degree of time degradation.

5. The heating device according to claim 3, wherein the circuitry is further configured to detect an environment temperature, and adjust the period of power distribution in the second time period in accordance with the detected environment temperature.

6. The heating device according to claim 1, wherein the circuitry is further configured to detect a temperature of the target, and end the power distribution control in the second time period and shift to a power distribution control in the third time period when the heating target reaches a predetermined temperature.

7. The heating device according to claim 6, wherein the circuitry is further configured to start the power distribution to the heater when the heating target reaches a heating start temperature lower than the target temperature.

8. The heating device according to claim 1, wherein the circuitry is further configured to obtain, as power distribution control patterns corresponding to the first time period, (1) a power distribution control pattern combining a five half-wave control performing power distribution for a period corresponding to one of five half-wave lengths and a three half-wave control performing power distribution for a period corresponding to one of three half-wave lengths, and (2) a power distribution control pattern combining a four half-wave control performing power distribution for a period corresponding to one of four half-wave lengths and a three half-wave control performing power distribution for a period corresponding to one of three half-wave lengths, and control power supply to the heater in accordance with one of the power distribution control patterns corresponding to a frequency of a commercial power source as a power supply source.

9. The heating device according to claim 1, wherein the circuitry is further configured to use a two half-wave control performing power distribution for a period corresponding to one of two half-wave lengths as the power distribution control pattern corresponding to the second time period.

10. The heating device according to claim 1, wherein the circuitry is further configured to use the power distribution control pattern combining the three half-wave control performing power distribution for a period corresponding to one of three half-wave lengths and the two half-wave control performing power distribution for a period corresponding to one of two half-wave lengths, as the power distribution control pattern corresponding to the third time period.

11. The heating device according to claim 1, wherein the heater includes a plurality of heat generating elements configured to independently control the power distribution, and wherein the circuit is further configured to control the supply of the AC power for each of the heat generating elements, and supply the AC power to only part of the plurality of heat generating elements at a power distribution timing in a first predetermined time period which timing is included in power distribution timings at which the power is supplied to the heater in accordance with the power distribution control pattern.

12. The heating device according to claim 11, wherein the circuitry is further configured to sequentially supply the AC power to the heat generating elements at the respective power distribution timings in the first predetermined time period.

13. The heating device according to claim 11, wherein the circuitry is further configured to supply the AC power to all the plurality of heat generating elements at the respective power distribution timings after the first predetermined time period.

14. The heating device according to claim 11, wherein the circuitry is further configured to define a number of power distribution timings at which the AC power is supplied to the respective heat generating elements based on an amount of heat to be generated in each of the heat generating elements, and determine to which of the heat generating elements the AC power is supplied at each power distribution timing within unit time in accordance with the number of power distribution timings.

15. An image forming apparatus comprising the heating device according to claim 1.

16. The heating device according to claim 1, wherein the power distribution circuit is further configured to select a power distribution control pattern corresponding to a frequency of a commercial power source as a power supply source.

17. A heating method comprising:

performing, with circuitry, power distribution to the heater in units of AC half waves only;

controlling, with the circuitry, the power supply to the heater in accordance with power distribution control patterns respectively corresponding to a first time period as a power distribution start period, when the power supply gradually starts supplying power to the heater over a first predetermined period of time, a third time period as a power distribution stop period, when the power supply gradually stops supplying power to the heater over a second predetermined period of time, and a second time period between the first time period and the third time period, when the power supply continuously supplies power to the heater; and supplying AC power to the heater in each of the first time period, the second time period, and the third time period.

18. The heating method according to claim 17, further comprising:

providing, for each frequency of a commercial power source, a power distribution control pattern corresponding to the first time period, and controlling the power supply to the heater in accordance with the power distribution control pattern according to a frequency of the commercial power source as a power supply source during the first time period.

19. The heating device according to claim 1, wherein the circuitry is further configured to calculate a predetermined duration for supplying power with a second electrification control pattern corresponding to the second time period, before controlling power distribution in the second time period.

20. The heating method according to claim 17, further comprising:

calculating, with the circuitry, a predetermined duration for supplying power with a second electrification control pattern corresponding to the second time period, before controlling power distribution in the second time period.

* * * * *